US010585364B2

(12) United States Patent
Suzuki et al.

(10) Patent No.: US 10,585,364 B2
(45) Date of Patent: Mar. 10, 2020

(54) ELECTROPHOTOGRAPHIC PHOTORECEPTOR, METHOD FOR PRODUCING THE SAME, AND ELECTROPHOTOGRAPHIC DEVICE INCLUDING THE SAME

(71) Applicant: FUJI ELECTRIC CO., LTD., Kawasaki-shi, Kanagawa (JP)

(72) Inventors: Shinjiro Suzuki, Matsumoto (JP); Tomoki Hasegawa, Hachioji (JP); Fengqiang Zhu, Matsumoto (JP); Yuji Ogawa, Matsumoto (JP); Hirotaka Kobayashi, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/943,682

(22) Filed: Apr. 2, 2018

(65) Prior Publication Data

US 2018/0224760 A1 Aug. 9, 2018

Related U.S. Application Data

(63) Continuation of application No. PCT/JP2016/083665, filed on Nov. 14, 2016.

(30) Foreign Application Priority Data

Dec. 24, 2015 (WO) ..... PCT/JP2015/086140

(51) Int. Cl.
*G03G 9/097* (2006.01)
*G03G 5/05* (2006.01)

(52) U.S. Cl.
CPC ..... *G03G 5/0564* (2013.01); *G03G 5/05* (2013.01); *G03G 5/051* (2013.01); *G03G 5/0507* (2013.01); *G03G 5/0578* (2013.01)

(58) Field of Classification Search
CPC ..... G03G 5/0503; G03G 5/0507
See application file for complete search history.

(56) References Cited

U.S. PATENT DOCUMENTS

| | | | |
|---|---|---|---|
| 5,213,924 | A | 5/1993 | Sakamoto |
| 5,679,488 | A | 10/1997 | Itami et al. |
| 2010/0216065 | A1 | 8/2010 | Kurachi et al. |

FOREIGN PATENT DOCUMENTS

| | | | |
|---|---|---|---|
| EP | 0713150 | A2 | 5/1996 |
| JP | S61-62040 | A | 3/1986 |

(Continued)

OTHER PUBLICATIONS

Translation of JP 2002-107985.*
Translation of JP 2002-182409.*
Translation of JP 08-146642.*

*Primary Examiner* — Peter L Vajda
(74) *Attorney, Agent, or Firm* — Rabin & Berdo, P.C.

(57) ABSTRACT

The invention provides an electrophotographic photoreceptor, which undergoes little abrasion over long term use and is able to develop a stable image, as well as a method of producing the same and an electrophotographic device including the same. The electrophotographic photoreceptor includes a conductive substrate; and a photosensitive layer that contains an inorganic oxide and that is formed on the conductive substrate from a coating liquid. A test slurry containing 20% by mass of the inorganic oxide dispersed in a solvent for forming the coating liquid has a light transmittance of 40% or more in a test case where light having a wavelength of 780 nm irradiates the test slurry.

15 Claims, 2 Drawing Sheets

(56) References Cited

FOREIGN PATENT DOCUMENTS

| | | | | | |
|---|---|---|---|---|---|
| JP | H0324558 | A | | 2/1991 | |
| JP | H03-273256 | A | | 12/1991 | |
| JP | H04-179961 | A | | 6/1992 | |
| JP | 08-146642 | | * | 6/1996 | ..... G03G 5/147 |
| JP | H08-146642 | A | | 6/1996 | |
| JP | 2002-107985 | | * | 4/2002 | ..... G03G 5/14 |
| JP | 2002-107985 | A | | 4/2002 | |
| JP | 2002-182409 | | * | 6/2002 | ..... G03G 5/05 |
| JP | 2002-182409 | A | | 6/2002 | |
| JP | 2004-085644 | A | | 3/2004 | |
| JP | 2004-354759 | A | | 12/2004 | |
| JP | 2007284503 | A | | 11/2007 | |
| JP | 2008-176054 | A | | 7/2008 | |
| JP | 2009-139533 | A | | 6/2009 | |
| JP | 2010-224529 | A | | 10/2010 | |
| JP | 2010-276699 | A | | 12/2010 | |
| JP | 2011095663 | A | | 5/2011 | |
| WO | 2015190609 | A1 | | 12/2015 | |

* cited by examiner

ELECTROPHOTOGRAPHIC PHOTORECEPTOR, METHOD FOR PRODUCING THE SAME, AND ELECTROPHOTOGRAPHIC DEVICE INCLUDING THE SAME

CROSS-REFERENCE TO RELATED APPLICATIONS

This non-provisional application is a continuation of International Application No. PCT/JP2016/083665 filed on Nov. 14, 2016, which claims priority from International Application No. PCT/JP2015/086140 filed on Dec. 24, 2015, the entire contents of both of which are incorporated herein by reference.

BACKGROUND OF THE INVENTION

1. Field of the Invention

The present invention relates to an electrophotographic photoreceptor (hereinafter also simply referred to as "photoreceptor") to be used in a printer, a copying machine, or a fax machine based on an electrophotographic system, as well as a method of producing the same and an electrophotographic device; and especially to an electrophotographic photoreceptor, which is able to exhibit superior resistance to abrasion, or stability in electrical properties owing to inclusion of a specific inorganic oxide in a photosensitive layer, as well as a method of producing the same and an electrophotographic device.

2. Background of the Related Art

An electrophotographic photoreceptor has a basic structure, in which a photosensitive layer having a photoconductive function is placed on a conductive substrate. An organic electrophotographic photoreceptor using an organic compound as a functional component responsible for generation or transport of electric charge has been recently studied actively and come to be used more and more in a copying machine, a printer, etc. in view of advantages of a great diversity of materials, high productivity, safety, etc.

Generally, a photoreceptor requires a function of retaining surface electric charge in a dark place, a function of generating electric charge by receiving light, and further a function of transporting the generated electric charge. As such a photoreceptor there are a so-called monolayer photoreceptor provided with a single layer of photosensitive layer having all of the functions, and a so-called stacked (functionally separated) photoreceptor provided with a photosensitive layer which stacks layers functionally separated into a charge generating layer mainly responsible for a function of generating electric charge upon receipt of light, and a charge transporting layer responsible for a function of retaining surface electric charge in a dark place, and a function of transporting electric charge generated upon receipt of light.

The photosensitive layer is generally formed by coating a coating liquid, in which a charge generating material, and a charge transporting material, as well as a resin binder are dissolved or dispersed in an organic solvent, on a conductive substrate. Especially, for a layer to constitute the outermost surface of an organic electrophotographic photoreceptor, polycarbonate, which is highly resistant to friction caused against paper or a blade for removing a toner, is superior in flexibility, and has high transparency for exposure light, is used frequently as a resin binder. Among others, a bisphenol Z polycarbonate is broadly used as a resin binder. Such a technology utilizing polycarbonate as a resin binder is described for example in Patent Document 1.

Further, due to increase in print quantity as the result of construction of a network in an office, or rapid expansion of light printing machine utilizing electrophotography, still higher resistance to abrasion, namely long-term durability, higher sensitivity, and higher responsiveness have come to be demanded recently for a printer according to an electrophotographic system.

Further, due to recent development and increase in the penetration rate of a color printer, increase in the printing speed, downsizing of a device, and reduction in number of parts have been advancing, and measures responding to various service environments have been also required. Under such circumstances, demand for a photoreceptor, which image characteristic or electrical property fluctuate little due to repeated use or fluctuation of service environment (room temperature, and environment), has been remarkably strengthening, and full satisfaction of such requirements by a conventional technology has become difficult.

For solving the problem, various methods for improving the outermost surface layer of a photoreceptor have been proposed.

Various polycarbonate resin structures have been proposed for improving the durability of a photoreceptor surface. For example, a polycarbonate resin containing a specific structure has been proposed in Patent Documents 2, and 3, however, the compatibility with various charge transporting agents or add-in materials, and the solubility of the resin have not been investigated sufficiently. Further, Patent Document 4 proposes a polycarbonate resin containing a specific structure, however in the case of a resin having a bulky structure there are many spaces among polymers and a discharging substance when electrified, a contact member, a foreign substance, etc. are apt to permeate into a photosensitive layer. Therefore, it is difficult to develop adequate durability. For the purpose of improvement of printing durability and coating property, Patent Document 5 proposes a polycarbonate having a special structure, however descriptions concerning a charge transporting material or an additive to be used in a combination are not sufficient, and there is a drawback in that stable maintenance of electrical properties over a long term use is difficult.

Patent Document 6 proposes addition of filler particles into a photosensitive layer for the purpose of improvement of resistance to abrasion, however an influence of aggregation of the particles in preparing a coating liquid for a photosensitive layer on photoreceptor characteristics, and on a method of producing particles, impurity control, and a surface treatment has not been examined adequately. Patent Document 7 proposes a charge transporting layer, in which pyrogenic silica is dispersed, however there is no description concerning the transparency of a slurry in which silica is dispersed in a solvent. Further, although there is a description concerning a metal element contained in silica in Patent Document 8, Patent Document 8 refers only to a technological basic idea with respect to existence or nonexistence of a contained metal element from the viewpoint of a factor of cost increase in production. There is no description concerning an impurity amount from the viewpoint of improvement of dispersibility.

RELATED ART DOCUMENTS

Patent Documents

Patent Document 1: Japanese Unexamined Patent Application Publication No. S61-62040

Patent Document 2: Japanese Unexamined Patent Application Publication No. 2004-354759

Patent Document 3: Japanese Unexamined Patent Application Publication No. H4-179961

Patent Document 4: Japanese Unexamined Patent Application Publication No. 2004-85644

Patent Document 5: Japanese Unexamined Patent Application Publication No. H3-273256

Patent Document 6: Japanese Unexamined Patent Application Publication No. 2008-176054

Patent Document 7: Japanese Unexamined Patent Application Publication No. 2002-182409

Patent Document 8: Japanese Unexamined Patent Application Publication No. H8-146642

As described above, various technologies have been heretofore proposed concerning improvement of a surface layer of a photoreceptor. However, none of the technologies described in the Patent Documents have been adequate in terms of image defects, etc. in practical use. Further, the properties of a coating liquid in coating a photosensitive layer have not been investigated thoroughly and, as a result it has been necessary to improve the properties of a coating liquid for a photosensitive layer for development of a photoreceptor with improved durability.

Under such a situation, an object of the present invention is to provide an electrophotographic photoreceptor, which undergoes little abrasion over long term use and is able to develop a stable image, as well as a method of producing the same and an electrophotographic device.

SUMMARY OF THE INVENTION

The inventors investigated diligently a material for the outermost surface layer of a photoreceptor for achieving the object to provide as the consequence a photoreceptor, which has an improved film abrasion property, gives an image with little defects, and is stable in image quality even after repetitive use. Specifically, the inventors have found that an excellent electrophotographic photoreceptor may be obtained by adopting a constitution described below, thereby completing the present invention.

Namely, an electrophotographic photoreceptor according to the present invention comprises a conductive substrate; and a photosensitive layer that comprises an inorganic oxide and that is formed on the conductive substrate from a coating liquid, wherein a test slurry containing 20% by mass of the inorganic oxide dispersed in a solvent for forming the coating liquid has a light transmittance of 40% or more in a test case where light having a wavelength of 780 nm irradiates the test slurry.

It has been found that, according to the present invention, the mechanical strength of a photosensitive layer is enhanced by adding an inorganic oxide into a photosensitive layer, and that a high-quality photoreceptor may be provided by using an inorganic oxide exhibiting very high transmittance when dispersed in a solvent for forming a photosensitive layer at a high concentration.

According to the present invention, the test slurry has a viscosity of preferably 50 mPa·s or less.

According to the present invention, any primary particle diameter of the inorganic oxide is acceptable, insofar as the transmittance may be kept high when dispersed in a solvent, and it is preferably from 1 to 200 nm.

Further, according to the present invention, the photosensitive layer is preferably an outermost layer.

Further, according to the present invention, the inorganic oxide contains preferably silica as a main component and, more preferably, silica as a main component and also 1 ppm to 1000 ppm of elemental aluminum or an aluminum compound. Further, the inorganic oxide is preferably surface-treated with a silane coupling agent.

According to the present invention, as the silane coupling agent one having a structure expressed by the following general formula (1) may be used:

$$(R^1)_n—Si—(OR^2)_{4-n} \quad (1),$$

where Si represents a silicon atom, $R^1$ represents an organic group, in which carbon bonds directly to the silicon atom, $R^2$ represents an organic group, and n represents an integer of 0 to 3.

Further, the silane coupling agent is preferably a surface treatment agent containing at least one kind selected out of the group consisting of phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatopropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatopropyltrimethoxysilane, 3-aminopropyltrimethoxysilane, and N-phenyl-3-aminopropyltrimethoxysilane.

Further, according to the present invention, it is also preferable that the inorganic oxide is surface-treated with plural kinds of the silane coupling agents, and a silane coupling agent used initially for the surface treatment has a structure expressed by the general formula (1). Further, it is also preferable that the coating liquid for the photosensitive layer contains a compound having a structure expressed by the following general formula (2) at 2% by mass or less:

$$Si(OH)_m(R^1)_n(OR^2)_{4-(n+m)} \quad (2),$$

where Si represents a silicon atom, $R^1$ represents an organic group, in which carbon bonds directly to the silicon atom, $R^2$ represents an organic group, m represents an integer of 1 to 4, and n represents an integer of 0 to 3, while m+n is 4 or less.

Further, according to the present invention, it is also preferable that the photosensitive layer further comprises a charge transporting material and a resin binder, wherein the coating liquid comprises the inorganic oxide dispersed in the solvent to provide an inorganic oxide slurry mixed with the charge transporting material and the resin binder dissolved in the solvent to provide a coating liquid precursor. It is also preferable that the photosensitive layer further comprises a charge transporting material, a resin binder, and a charge generating material, wherein the coating liquid comprises a mixture of the inorganic oxide dispersed in the solvent to provide an inorganic oxide slurry with the charge transporting material and the resin binder dissolved in the solvent to provide a coating liquid precursor, and the charge generating material dispersed in the mixture.

In this case, the photoreceptor contains preferably an arylamine compound as the charge transporting material, contains also preferably an electron transporting material as the charge transporting material, or contains also preferably a phthalocyanine compound as the charge generating material.

A method for producing the electrophotographic photoreceptor according to the present invention in which a photosensitive layer is formed using a coating liquid for a photosensitive layer, comprises dispersing primarily the inorganic oxide in a solvent for the coating liquid to provide an inorganic oxide slurry; dissolving a charge transporting material and a resin binder in a solvent for the coating liquid to provide a coating liquid precursor; and mixing the inorganic oxide slurry and the coating liquid precursor for forming a photosensitive layer obtained above. The method may further comprise drying the coated layer in a drying apparatus under conditions of temperature, pressure, and duration effective for drying to provide the photosensitive layer of the electrophotographic photoreceptor.

An electrophotographic device according to the present invention is mounted with the electrophotographic photoreceptor.

Further, a coating liquid for forming a photosensitive layer, comprises an inorganic oxide slurry comprising primarily an inorganic oxide dispersed in a solvent; and a coating precursor liquid comprising a charge transporting material and a resin binder dissolved in the solvent, and mixed with the inorganic oxide slurry, wherein a test slurry containing 20% by mass of the inorganic oxide dispersed in a solvent for forming the coating liquid has a light transmittance of 40% or more in a test case where light having a wavelength of 780 nm irradiates the test slurry.

EFFECTS OF THE INVENTION

It has become clear that a photoreceptor, which is able to maintain stable image quality and to control abrasion property, may be obtained by using a photosensitive layer satisfying the above conditions according to the present invention.

This is conceivably because of the following reasons. Although it is intended according to the present invention to enhance the mechanical strength of a photosensitive layer by adding an inorganic oxide into a photosensitive layer, in a case in which an inorganic oxide is dispersed singly in a photosensitive layer solvent by a conventional technology, an aggregated part appears, which will not be dispersed sufficiently, when the oxide is mixed afterward with a charge transporting material and a resin component for dispersion, because of increased viscosity due to addition of the a resin component. As a result, a photoreceptor with a drawback that an image has a micro defect is formed. In contrast according to the present invention, even when an inorganic oxide is dispersed in a photosensitive layer solvent at a high concentration, a very high light transmittance is exhibited to demonstrate that the inorganic oxide is in a uniformly dispersed state maintaining a solvated state of nearly primary particles. In other words, according to the present invention, even when an inorganic oxide is dispersed in a solvent at a high concentration, the viscosity of a slurry (dispersion liquid) is low, and consequently mixture with a coating liquid having dissolved another constituent of a photosensitive layer becomes easy, so that the aggregating tendency in mixing may be mitigated and a higher quality photoreceptor may be provided.

BRIEF DESCRIPTION OF THE DRAWINGS

FIGS. 1A, 1B, and 1C are a schematic cross-sectional view showing an example of an electrophotographic photoreceptor according to the present invention, wherein FIG. 1A shows a negatively-charged stacked electrophotographic photoreceptor, FIG. 1B shows a positively-charged monolayer electrophotographic photoreceptor, and FIG. 1C shows a positively-charged stacked electrophotographic photoreceptor, respectively;

DETAILED DESCRIPTION OF THE INVENTION

A specific embodiment of an electrophotographic photoreceptor according to the present invention will be described in detail below by way of drawings, provided that the present invention be not restricted in any way by the following description.

Figure 1A:
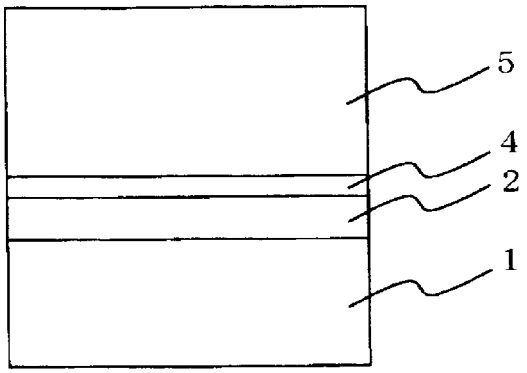
Figure 1B:
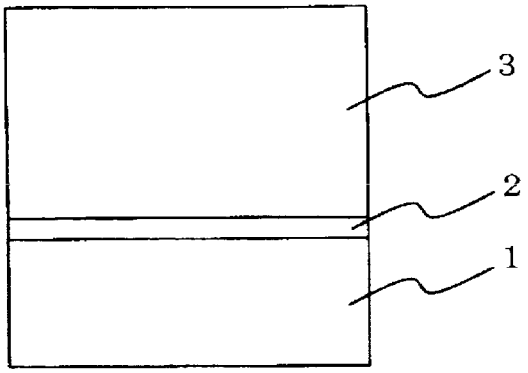
Figure 1C:
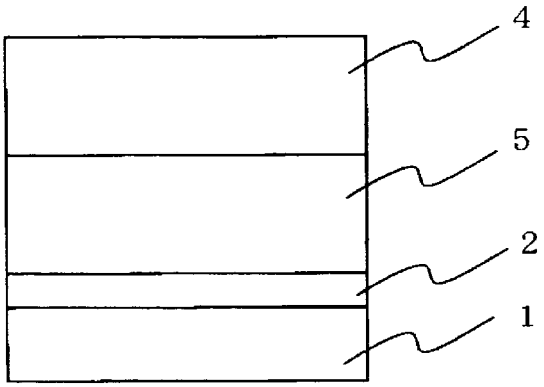

Electrophotographic photoreceptors are roughly classified into stacked (functionally separated) photoreceptors including so-called negatively-charged stacked photoreceptors and positively-charged stacked photoreceptors, and monolayer photoreceptors mainly used as a positively-charged type. FIG. 1 is a schematic cross-sectional view showing an example of an electrophotographic photoreceptor according to the present invention, wherein FIG. 1A shows a negatively-charged stacked electrophotographic photoreceptor, FIG. 1B shows a positively-charged monolayer electrophotographic photoreceptor, and FIG. 1C shows a positively-charged stacked electrophotographic photoreceptor, respectively.

As illustrated, in a negatively-charged stacked photoreceptor, on a conductive substrate 1, an undercoat layer 2, and a photosensitive layer having a charge generating layer 4 provided with a charge generating function, and a charge transporting layer 5 provided with a charge transporting function are layered one on another. In a positively-charged monolayer photoreceptor, on a conductive substrate 1, an undercoat layer 2, and a monolayer photosensitive layer 3 having both a charge generating function and a charge transporting function are layered one on another. Further, in a positively-charged stacked photoreceptor, on a conductive substrate 1, an undercoat layer 2, and a photosensitive layer having a charge transporting layer 5 provided with a charge transporting function, and a charge generating layer 4 provided with both a charge generating function and a charge transporting function are layered one on another. In any type of the photoreceptors, an undercoat layer 2 may be provide according to need.

A photoreceptor according to the present invention has at least a photosensitive layer on a conductive substrate, and the photosensitive layer contains an inorganic oxide, wherein a test slurry containing 20% by mass of the inorganic oxide dispersed in a solvent for forming the coating liquid has a light transmittance of 40% or more in a test case where light having a wavelength of 780 nm irradiates the test slurry. The transmittance is preferably 80% or more.

In a case where a photoreceptor according to the present invention is a stacked type, a charge generating layer or a charge transporting layer is a photosensitive layer containing the inorganic oxide, and in a case where a photoreceptor is a monolayer type, a monolayer photosensitive layer constitutes a photosensitive layer containing the inorganic oxide. Especially, a case where a photosensitive layer containing the inorganic oxide constitutes the outermost layer is preferable because the resistance to abrasion is improved effectively.

There is no particular restriction on an inorganic oxide to be used according to the present invention, insofar as the transmittance when dispersed in a coating liquid solvent is within the aforedescribed range. Examples thereof include, in addition to that containing silica as a main component, alumina, zirconia, titanium oxide, tin oxide, and zinc oxide.

Among others, as an inorganic oxide an inorganic oxide containing silica as a main component is preferable. As a method for producing silica, particularly a silica particle having a particle diameter roughly between several nanometers and several tens of nanometers, a production method, which is called as a wet process, and by which water glass is used as a source material; a method, which is called as a dry process, and by which chlorosilane, etc. are reacted in a gas phase; and a method, by which an alkoxide as a silica precursor is used as a source material, have been known.

When silica is to be surface-treated, if a different metal is present as an impurity in a large amount, a defect may be formed by the metal different from an ordinary oxide site to change the electric charge distribution on a surface, and to promote aggregation of oxide particles originated from the site, and to increase as the consequence aggregates in a coating liquid or a photosensitive layer. Therefore, high purity silica is preferable. The content of a metal other than a metal element composing an inorganic oxide is preferably regulated to 1000 ppm or less with respect to each metal element.

On the other hand, in order to improve the activity of a silica surface through adequate reaction with a surface treatment agent, it is appropriate to add a trace amount of another kind of metal. A surface treatment agent reacts with a hydroxy group present on a silica surface, and when the silica contains a trace amount of another metal element, the reactivity of a silanol group (hydroxy group) adjacent to such other metal element present on a silica surface is enhanced by an influence of intermetallic difference in electronegativity. Since the hydroxy group has high reactivity with a surface treatment agent, it reacts more firmly with a surface treatment agent than other hydroxy groups, and when it still exists, it may cause aggregation. After its reaction with a surface treatment agent, the surface treatment agent reacts with other hydroxy groups, so that aggregation among silica particles is conceivably suppressed greatly owing to an effect of a surface treatment agent, and an effect of reduction of a bias in surface charge owing to a different metal on the surface. According to the present invention it is preferable that an inorganic oxide should contain trace amount amount of another metal, because the reactivity of a surface treatment agent is improved, and as the result the dispersibility by a surface treatment is further enhanced.

With respect to silica, addition of an aluminum element in a range of 1000 ppm or less is appropriate for a surface treatment. Although adjustment of an aluminum element amount in silica may be carried out by a method according to Japanese Unexamined Patent Application Publication No. 2004-143028, Japanese Unexamined Patent Application Publication No. 2013-224225, Japanese Unexamined Patent Application Publication No. 2015-117138, or the like, there is no particular restriction on the adjustment method, insofar as regulation to a desired range is possible. Specific examples of a method for regulating more appropriately an aluminum element amount on a silica surface include the following methods. Firstly, there is a method, by which the aluminum amount on a silica surface is regulated by adding an aluminum alkoxide as an aluminum source after growth of a silica particle in a shape smaller than an intended silica particle diameter in producing a silica fine particle. Further, there is a method, by which a silica fine particle is added into a solution containing aluminum chloride to coat the aluminum chloride solution over a silica fine particle surface, and the product is dried and baked; or also a method, by which a mixed gas of a halogenated aluminum compound and a halogenated silicon compound is reacted.

The structure of silica has been known to take a combined network structure in which plural silicon atoms and oxygen atoms are aligned annularly, and when an aluminum element is incorporated, the number of atoms constituting the annular structure of silica becomes larger than ordinary silica due to the effect of mingled aluminum. The steric hindrance against a reaction of a surface treatment agent with a hydroxy group on a silica surface containing an aluminum element is mitigated compared to an ordinary silica surface owing to the above effect, such that the reactivity of a surface treatment agent is enhanced and a surface-treated silica with improved dispersibility compared to a reaction of the same surface treatment agent with ordinary silica.

Although silica described in Patent Document 7, etc. is produced by a dry process, silica by a wet process is more appropriate for regulating the aluminum element amount in order to develop the effect of the present invention. The content of an aluminum element is preferably 1 ppm or more with respect to silica considering the reactivity of a surface treatment agent.

Although there is no particular restriction on the shape of an inorganic oxide, the sphericity of an inorganic oxide is preferably 0.8 or more, and more preferably 0.9 or more in order to mitigate the aggregating tendency and to obtain a uniform dispersion state.

The viscosity of a 20% by mass inorganic oxide slurry prepared by dispersing 20% by mass of an inorganic oxide in a solvent of a coating liquid for a photosensitive layer (primary dispersion) is preferably 50 mPa·s or less, because favorable mixing can be performed, and more preferably 10 mPa·s or less.

There is no particular restriction on the primary particle diameter of an inorganic oxide, insofar as the transmittance can be kept high when the same is dispersed in a solvent, and it is appropriately from 1 to 200 nm, more preferably from 5 to 100 nm, and further preferably from 10 to 50 nm. In this regard, dispersed particles may be in a form of primary particles, or several particles may form a cluster, insofar as the transmittance is in the above range.

Although there is no particular restriction on the mean interparticle distance of inorganic oxides in a photosensitive layer, insofar as the above transmittance when dispersed in the solvent is obtained, it has turned out that it is preferably close to a primary particle diameter, because the binding force on film components is enhanced by an interparticle interaction, which contributes to improvement of the abrasion property of the film. Specifically, it is preferably 200 nm or less, and more preferably 70 nm or less.

When an inorganic oxide is used in a charge transporting layer of a photoreceptor, for which high resolution is anticipated, an effect of α-ray, or the like originated from a material added in a charge transporting layer should be preferably taken into consideration. For example, in the case of a semiconductor memory device, a memory device holds the type of data to be stored by existence or nonexistence of charge accumulation. Meanwhile through micronization, the amount of accumulated charge is also decreased, and the data type may be altered by electric charge in such a small magnitude as is changeable even by irradiation with α-ray from outside, such that an unexpected data change may take place as the consequence. Further, since the magnitude of a current to flow in a semiconductor device is also reduced, a current generated by α-ray (noise) has a relatively higher impact compared to the magnitude of a signal, and there arises a risk of malfunction. Taking into consideration an influence on the movement of an electric charge in a charge transporting layer of a photoreceptor in addition to the above aspect, it is more appropriate to use a material emitting less α-ray as a film forming material. Specifically, it is effective to reduce the concentrations of uranium and thorium in an inorganic oxide. Preferably the thorium content is 30 ppb or less, and the uranium content is 1 ppb or less. Examples of a production method able to reduce the contents of uranium or thorium in an inorganic oxide include that described in Japanese Unexamined Patent Application Publication No. 2013-224225, however not limited thereto insofar as the concentration of the elements can be reduced.

For an inorganic oxide to secure the requirement concerning the transmittance under the present invention, it is appropriate to perform a surface treatment on the surface of an inorganic oxide.

A commercially-supplied surface treatment agent may be used as the surface treatment agent insofar as the above transmittance is secured. More preferably a silane coupling agent is used. Examples of a silane coupling agent include phenyltrimethoxysilane, vinyltrimethoxysilane, epoxytrimethoxysilane, methacryltrimethoxysilane, aminotrimethoxysilane, ureidotrimethoxysilane, mercaptopropyltrimethoxysilane, isocyanatopropyltrimethoxysilane, phenylaminotrimethoxysilane, acryltrimethoxysilane, p-styryltrimethoxysilane, 3-acryloxypropyltrimethoxysilane, 3-methacryloxypropyltrimethoxysilane, 3-isocyanatopropyltrimethoxysilane, 3-aminopropyltrimethoxysilane, and N-phenyl-3-aminopropyltrimethoxysilane; and those containing at least one kind of the above may be used. As the alkyl group of the alkoxide, a methyl group is preferable, and alternatively an ethyl group, a propyl group, and a butyl group are also preferable. The amount of a surface treatment agent to be applied to an inorganic oxide is from 0.01 to 10.0% by mass in terms of the amount of a surface treatment agent with respect to the mass of an inorganic oxide after the treatment, and preferably from 0.05 to 5.0% by mass.

More particularly, examples of a silane coupling agent to be used according to the present invention may include compounds having a structure expressed by the following general formula (1), but not limited thereto insofar as it is a compound capable of condensation reaction with a reactive group such as a hydroxy group on an inorganic particle surface.

$$(R^1)_n—Si—(OR^2)_{4-n} \quad (1)$$

(wherein, Si represents a silicon atom, $R^1$ represents an organic group, in which carbon bonds directly to the silicon atom, $R^2$ represents an organic group, and n represents an integer of 0 to 3.)

Examples of $R^1$ in an organic silicon compound expressed by the general formula (1) include an alkyl group, such as methyl, ethyl, propyl, butyl, pentyl, hexyl, octyl, and dodecyl; an aryl group, such as phenyl, tolyl, naphthyl, and biphenyl; an epoxy-containing group, such as γ-glycidoxypropyl, and β-(3,4-epoxycyclohexyl)ethyl; a (meth)acryloyl-containing group, such as γ-acryloxypropyl, and γ-methacryloxypropyl; a hydroxy-containing group, such as γ-hydroxypropyl, and 2,3-dihydroxypropyl oxypropyl; a vinyl-containing group, such as vinyl, and propenyl; a mercapto-containing group, such as γ-mercaptopropyl; an amino-containing group, such as p-aminophenyl, γ-aminopropyl, N-β(aminoethyl)-γ-aminopropyl, and N-phenyl-3-aminopropyl; and a halogen-containing group, such as m-aminophenyl, o-aminophenyl, γ-chloropropyl, 1,1,1-trifluoropropyl, nonafluorohexyl, and (perfluorooctyl)ethyl; as well as a nitro-, cyano-substituted alkyl group. Further, examples of a hydrolyzable group of $OR^2$ include an alkoxy group, such as methoxy, and ethoxy; a halogen group; and an acyloxy group.

Silane coupling agents expressed by the general formula (1) may be used singly or in a combination of two or more kinds. When plural kinds are used in a combination, two kinds of coupling agents may be reacted with an inorganic oxide at the same time, or plural kinds may be reacted one by one.

In a case in which the n in a silane coupling agent expressed by the general formula (1) is 2 or higher, the plural $R^1$ may be the same or different. Similarly, in a case in which the n is 2 or less, the plural $R^2$ may be the same or different. Further, in a case in which two or more kinds of organic silicon compounds expressed by the general formula (1), $R^1$ and $R^2$ in a coupling agent may be the same or different.

Examples of a compound, for which the n is 0, include the following compounds. Namely are included tetramethoxysilane, tetraacetoxysilane, tetraethoxysilane, tetraallyloxysilane, tetrapropoxysilane, tetraisopropoxysilane, tetrakis(2-methoxyethoxy)silane, tetrabutoxysilane, tetraphenoxysilane, tetrakis(2-ethylbutoxy)silane, and tetrakis(2-ethylhexyloxy)silane.

Examples of a compound, for which the n is 1, include the following compounds. Namely are included methyltrimethoxysilane, mercaptomethyltrimethoxysilane, trimethoxyvinylsilane, ethyltrimethoxysilane, 3,3,3-trifluoropropyltrimethoxysilane, 3-chloropropyltrimethoxysilane, triethoxysilane, 3-mercaptopropyltrimethoxysilane, 3-aminopropyltrimethoxysilane, 2-aminoethylaminomethyltrimethoxysilane, methyltriacetoxysilane, chloromethyltriethoxysilane, ethyltriacetoxysilane, phenyltrimethoxysilane, 3-allylthiopropyltrimethoxysilane, 3-glycidoxypropyltrimethoxysilane, 3-bromopropyltriethoxysilane, 3-allylaminopropyltrimethoxysilane, propyltriethoxysilane, hexyltrimethoxysilane, 3-aminopropyltriethoxysilane, N-phenyl-3-aminopropyltrimethoxysilane, 3-methacryloxypropyltrimethoxysilane, bis(ethyl methyl ketoxime)methoxymethylsilane, pentyltriethoxysilane, octyltriethoxysilane, and dodecyltriethoxysilane.

Examples of a compound, for which the n is 2, include the following compounds. Namely are included dimethoxymethylsilane, dimethoxydimethylsilane, diethoxysilane, diethoxymethylsilane, dimethoxymethyl-3,3,3-trifluoropropylsilane, 3-chloropropyldimethoxymethylsilane, chloromethyldiethoxysilane, diethoxydimethylsilane, dimethoxy-3-mercaptopropylmethylsilane, diacetoxymethylvinylsilane, diethoxymethylvinylsilane, 3-aminopropyldiethoxymethylsilane, 3-(2-aminoethylaminopropyl)dimethoxymethylsilane, 3-methacryloxypropyldimethoxymethylsilane, 3-(3-cyanopropylthiopropyl)dimethoxymethylsilane, 3-(2-acetoxyethylthiopropyl)dimethoxymethylsilane, dimethoxymethyl-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxypropylthio)propyldimethoxymethylsilane, dimethoxymethyl-3-piperidinopropylsilane, and diethoxymethyloctadecylsilane.

Examples of a compound, for which the n is 3, include the following compounds. Namely are included methoxytrimethylsilane, ethoxytrimethylsilane, methoxydimethyl-3,3,3-trifluoropropylsilane, 3-chloropropylmethoxydimethylsilane, and methoxy-3-mercaptopropylmethylmethylsilane.

A trace amount of a hydrolysis product of a silane coupling agent may be contained in a coating liquid for a photosensitive layer according to the present invention.

Specifically, a compound having a structure expressed by the following general formula (2) may be contained at 2% by mass or less:

$$Si(OH)_m(R^1)_n(OR^2)_{4-(n+m)} \quad (2),$$

where, Si represents a silicon atom, $R^1$ represents an organic group, in which carbon bonds directly to the silicon atom, $R^2$ represents an organic group, m represents an integer of 1 to 4, and n represents an integer of 0 to 3, while m+n is 4 or less.

In a case in which an inorganic oxide is surface-treated with plural kinds of surface treatment agents, surface treatments may be carried out in any order in a surface treatment step. However, when an inorganic oxide is surface-treated, for example, with plural kinds of silane coupling agents, it is preferable that a silane coupling agent having a structure expressed by the following general formula (1) is used in the first place for a surface treatment. Further, silica may be surface-treated in a surface treatment step with a silane coupling agent and an organosilazane at the same time, or silica may be first surface-treated with a silane coupling agent, and then surface-treated with an organosilazane. Alternatively, silica may be first surface-treated with an organosilazane, and then surface-treated with a silane coupling agent, and thereafter further surface-treated with an organosilazane.

The wavelength for measuring the transmittance of a 20% by mass inorganic oxide slurry (inorganic oxide slurry) according to the present invention, may be optionally selected between a visible range and a wavelength range of laser used for exposure of an electrophotographic device, and it may be confirmed with a transmittance at a wavelength of 780 nm used in an electrophotographic device.

There is no particular restriction on a solvent used for forming a slurry, insofar as it is a solvent for a coating liquid for a photosensitive layer, and allows the inorganic oxide to satisfy the transmittance. Preferable examples thereof include tetrahydrofuran (THF), 1,3-dioxolane, tetrahydropyran, ethyl methyl ketone, methyl isobutyl ketone, cyclohexanone, toluene, methylene chloride, 1,2-dichloroethane, chlorobenzene, ethylene glycol, ethylene glycol monomethyl ether, and 1,2-dimethoxyethane. The above may be used singly or in a mixture, without limitation thereto. Preferably, tetrahydrofuran, or a mixed solvent containing the same may be used.

The inorganic oxide slurry may be yielded according to the present invention by mixing with agitation irrespective of its method. Examples of a disperser used for dispersion to form a slurry include a paint shaker, a ball mill, and a sand mill.

In preparing a coating liquid for a photosensitive layer for forming a photosensitive layer containing the inorganic oxide according to the present invention, an inorganic oxide slurry is firstly prepared by dispersing primarily the inorganic oxide in a solvent for a coating liquid for a photosensitive layer, and in mixing the slurry with another constituent component for a photosensitive layer they may be dissolved or dispersed in any optional order. For example, in a case in which a photosensitive layer is a negatively-charged stacked photosensitive layer, and a charge transporting layer contains the inorganic oxide, a production method, by which a liquid for forming a photosensitive layer (liquid for charge transporting layer) by dissolving a charge transporting material and a resin binder in a solvent for a coating liquid for a photosensitive layer is firstly prepared, and then the same is added into the inorganic oxide slurry, is preferable. Meanwhile, if a photosensitive layer is a positively-charged monolayer photosensitive layer, and a monolayer photosensitive layer contains the inorganic oxide, a liquid for forming a photosensitive layer prepared by dissolving a charge transporting material and a resin binder in a solvent for a coating liquid for a photosensitive layer, and further by dispersing (secondary dispersion) a charge generating material therein may be used.

(Conductive Substrate)

A conductive substrate 1 functions as an electrode of a photoreceptor, and at the same time as a support for respective layers constituting a photoreceptor. It may take any shape, such as cylinder, plate, and film. As a material for a conductive substrate 1, a metal, such as aluminum, stainless steel, and nickel; or glass or resin on which surface an electroconductive treatment has been conducted may be used.

(Undercoat Layer)

An undercoat layer 2 is constituted with a layer containing a resin as a main component and a metal oxide film such as alumite. Such an undercoat layer 2 is formed, if necessary, for the purpose of regulating an injection property of electric charge from a conductive substrate 1 to a photosensitive layer, covering a surface defect of a conductive substrate, or improvement of adhesion between a photosensitive layer and a conductive substrate 1. Examples of a resin material used for an undercoat layer 2 include an insulating polymer, such as casein, poly(vinyl alcohol), polyamide, melamine, and cellulose, and an electroconductive polymer, such as polythiophene, polypyrrole, and polyaniline, and the resins may be used singly, or as a mixture of an appropriate combination thereof. The resins may be used after adding a metallic oxide, such as titanium dioxide, and zinc oxide.

(Negatively-Charged Stacked Photoreceptor)

A photoreceptor according to the present invention may have any of the layer constitutions shown in FIGS. 1A to 1C, insofar as the requirement with respect to an inorganic oxide is satisfied. A photoreceptor according to the present invention is preferably a negatively-charged stacked electrophotographic photoreceptor, and in this case the outermost layer is a charge transporting layer. As described above a photosensitive layer in a negatively-charged stacked photoreceptor has a charge generating layer 4 and a charge transporting layer 5.

A charge generating layer 4 in a negatively-charged stacked photoreceptor is formed by a method, by which, for example, a coating liquid having dispersed particles of a charge generating material in a resin binder is coated, and receives light to generate electric charge. With respect to the charge generating layer 4, a high charge generation efficiency, and also injection capability of the generated electric charge into a charge transporting layer 5 are important, and desirably the electric field dependency is low, and high injection capability is secured even with a low electric field.

As a charge generating material, a phthalocyanine compound, such as an X-type metal-free phthalocyanine, a τ-type metal-free phthalocyanine, an α-type titanyl phthalocyanine, a β-type titanyl phthalocyanine, a Y-type titanyl phthalocyanine, a γ-type titanyl phthalocyanine, an amorphous titanyl phthalocyanine, and an ε-type copper phthalocyanine, various azo pigments, anthanthrone pigments, thiapyrylium pigments, perylene pigments, perinone pigments, squarylium pigments, quinacridone pigments, etc. may be used singly or in an appropriate combination, and an appropriate substance may be selected corresponding to the light wavelength range of an exposure light source used for image formation. Especially, a phthalocyanine compound may be used favorably. A charge generating layer 4, which contains a charge generating material as a main component, and to which a charge transporting material, etc. are added, may be also used.

As a resin binder for a charge generating layer 4, a polycarbonate resin, a polyester resin, a polyamide resin, a polyurethane resin, a vinyl acetate resin, a phenoxy resin, a poly(vinyl acetal) resin, a poly(vinyl butyral) resin, a polystyrene resin, a polysulfone resin, a diallyl phthalate resin, and a resin of a polymer and a copolymer of a methacrylate may be used singly or in an appropriate combination.

The content of a charge generating material in a charge generating layer 4 is favorably from 20 to 80% by mass with respect to the solid content in a charge generating layer 4, and more favorably from 30 to 70% by mass. Meanwhile, the content of a resin binder in a charge generating layer 4 is favorably from 20 to 80% by mass with respect to the solid content in a charge generating layer 4, and more favorably from 30 to 70% by mass. Since a charge generating layer 4 is required only to have a charge generating function, its film thickness is generally 1 μm or less, and favorably 0.5 μm or less.

In the case of a negatively-charged stacked photoreceptor, a charge transporting layer 5 constitutes a photosensitive layer containing the inorganic oxide. In a negatively-charged stacked photoreceptor, a charge transporting layer 5 is constituted mainly with the inorganic oxide, a charge transporting material, and a resin binder.

As a resin binder for a charge transporting layer 5, various polycarbonate resins, such as a polyarylate resin, a bisphenol A type, a bisphenol Z type, a bisphenol C type, a bisphenol A type-biphenyl copolymer, and a bisphenol Z type-biphenyl copolymer, may be used singly or in a mixture of plural kinds thereof. Further, the same kind of resins with a different molecular weight may be used in a mixture. Besides the above, a polyphenylene resin, a polyester resin, a poly(vinyl acetal) resin, a poly(vinyl butyral) resin, a poly(vinyl alcohol) resin, a vinyl chloride resin, a vinyl acetate resin, a polyethylene resin, a polypropylene resin, an acrylic resin, a polyurethane resin, an epoxy resin, a melamine resin, a silicone resin, a polyamide resin, a polystyrenic resin, a polyacetal resin, a polysulfone resin, a polymer of a methacrylate, and a copolymer thereof may be used.

The weight-average molecular weight of the resin in terms of polystyrene according to GPC (gel permeation chromatography) analysis is favorably from 5,000 to 250,000, and more favorably from 10,000 to 200,000.

As a charge transporting material in a charge transporting layer 5 various hydrazone compounds, styryl compounds, diamine compounds, butadiene compounds, indole compounds, arylamine compounds, etc. may be used singly or in an appropriate combination. Examples of such a charge transporting material include the following (II-1) to (II-30) but not limited thereto.

II-1

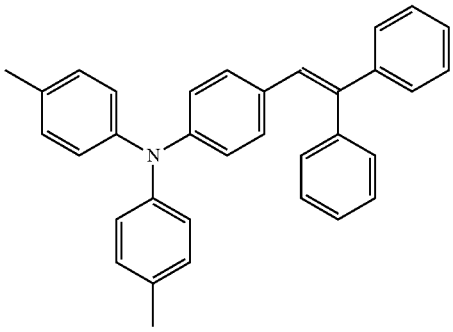

II-2

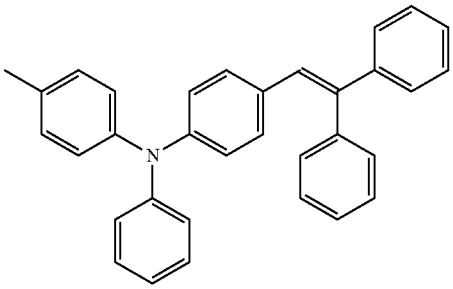

II-3

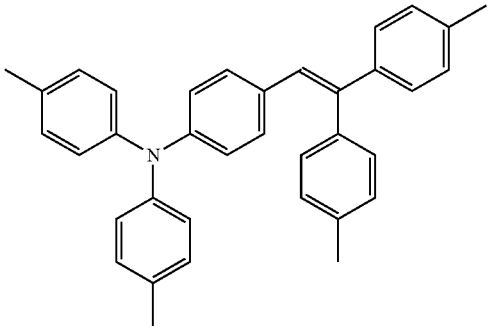

II-4

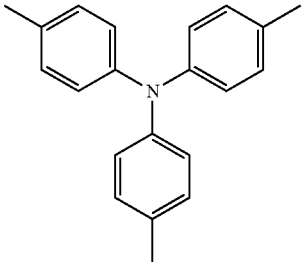

II-5

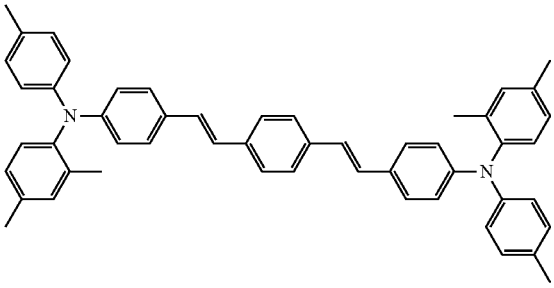

II-6

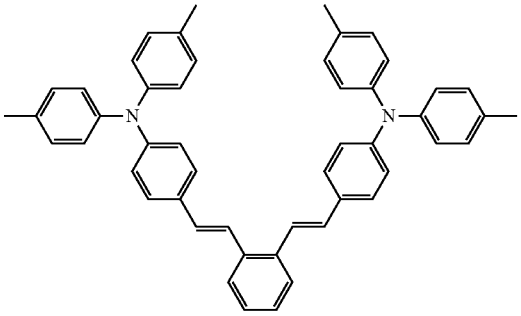

-continued
II-7
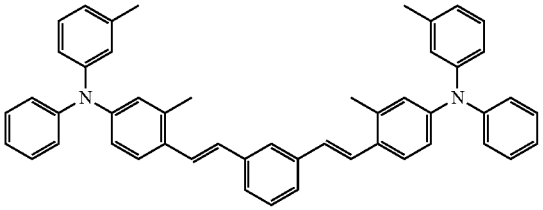
II-8
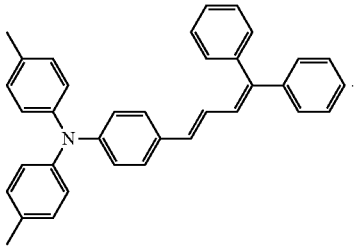
II-9
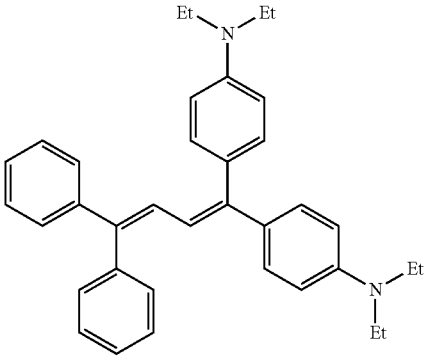
II-10
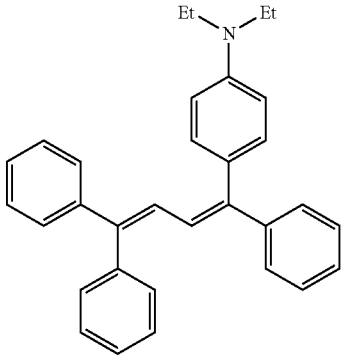
II-11
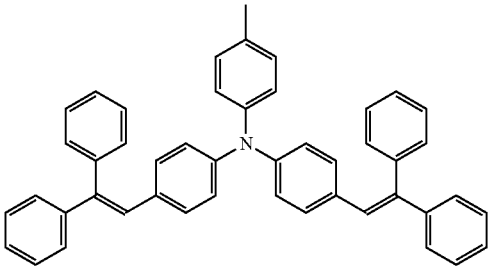
II-12
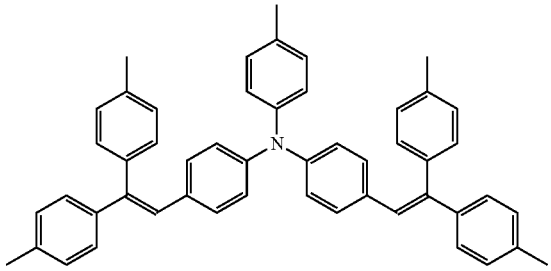
II-13
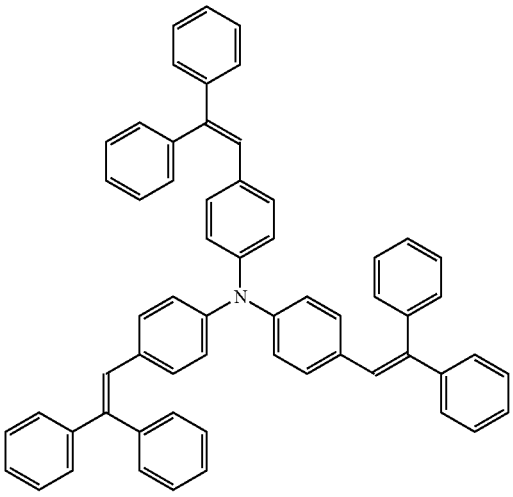
II-14
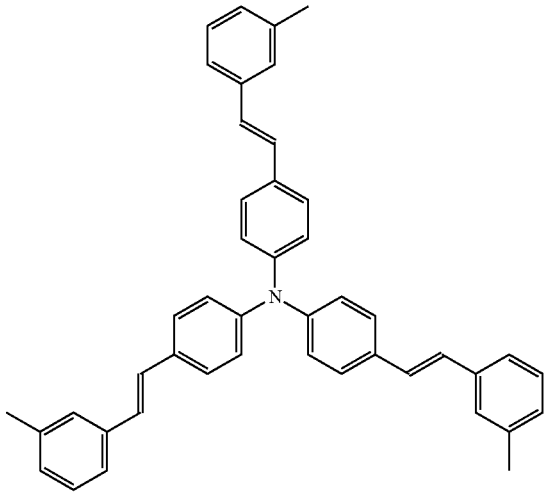

-continued
II-15
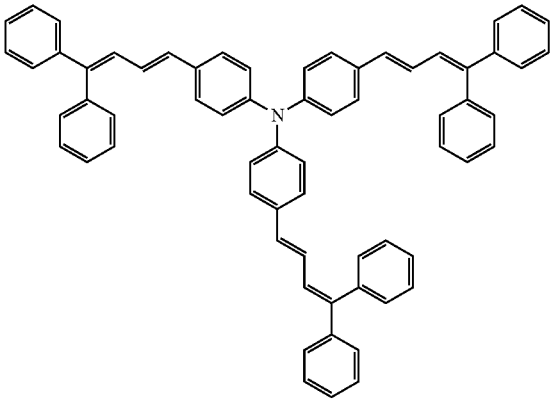
II-16
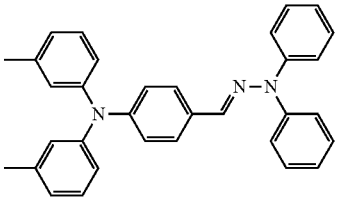
II-17
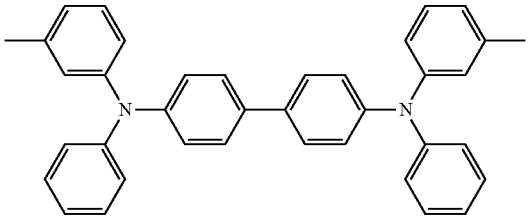
II-18
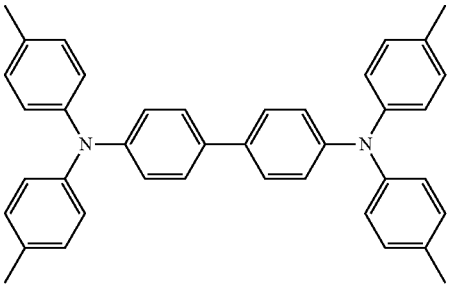
II-19
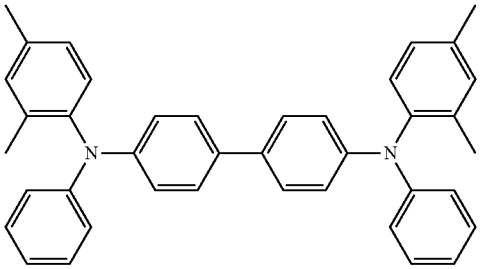
II-20
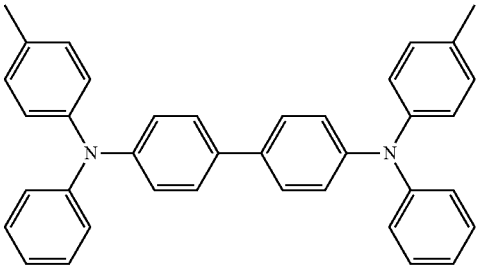
II-21
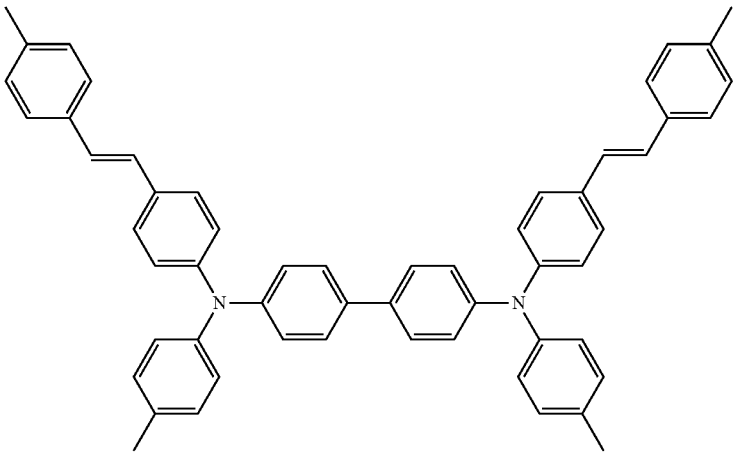

-continued
II-22
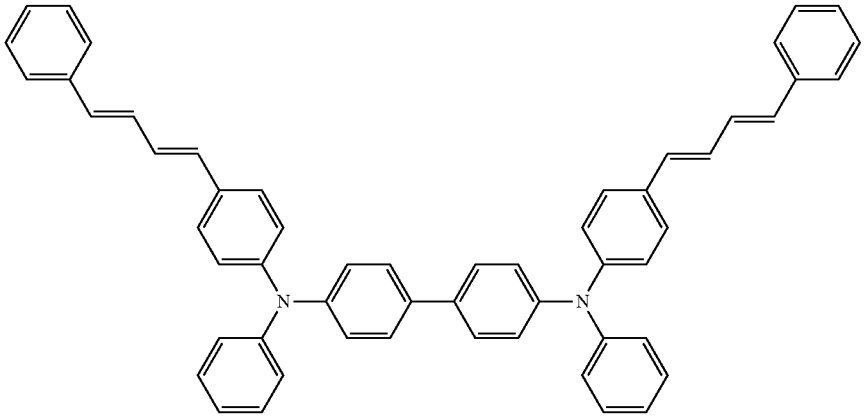
II-23
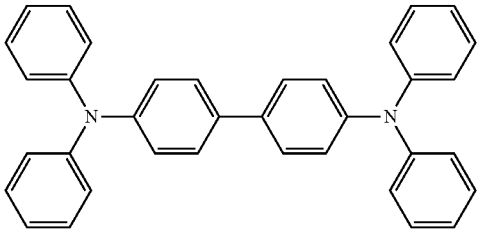
II-24
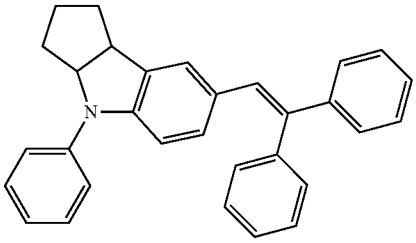
II-25
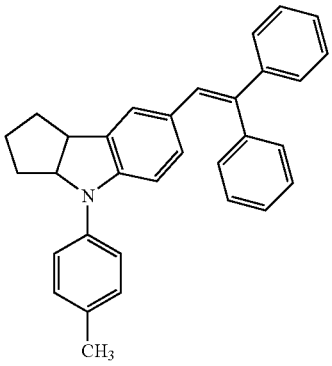
II-26
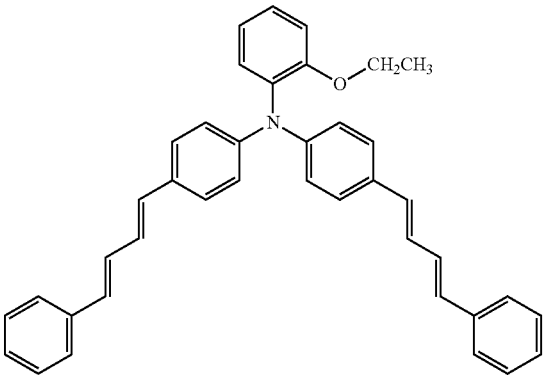
II-27
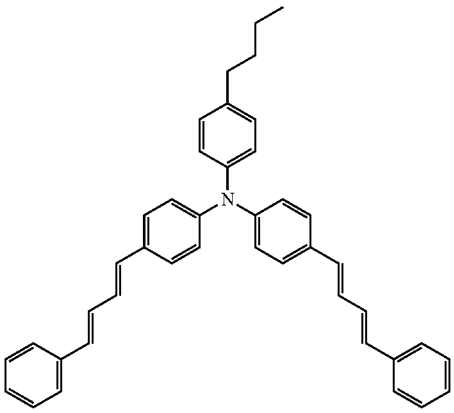
II-28
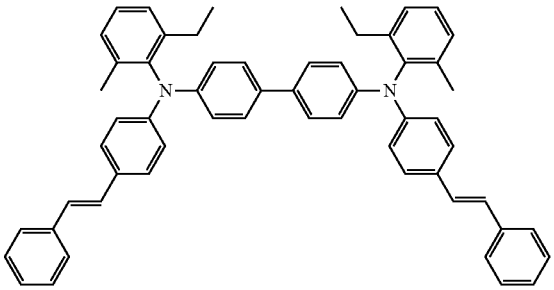

-continued

II-29

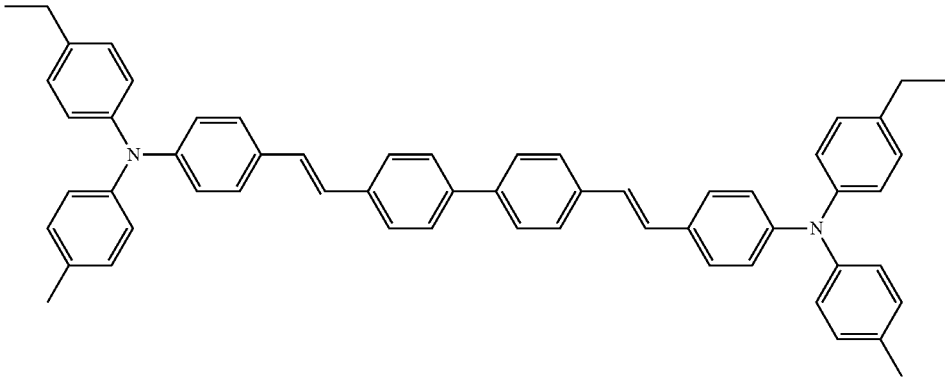

II-30

(1)

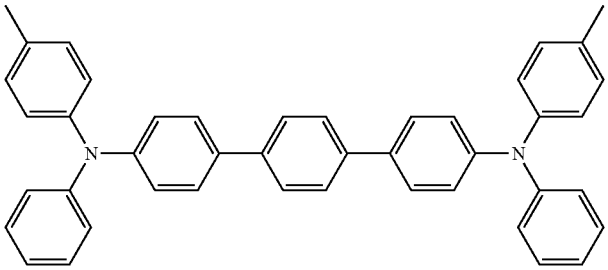

(2)

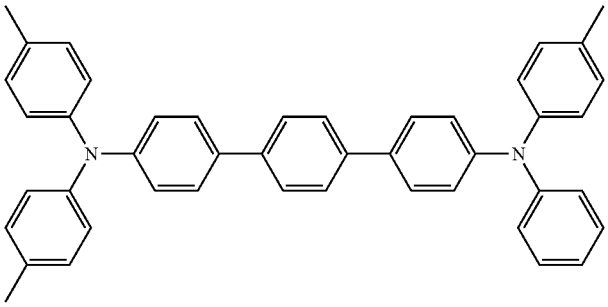

(3)

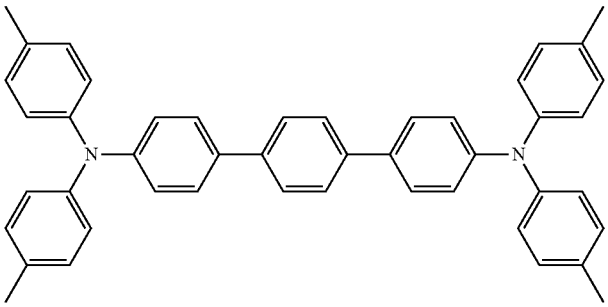

(1):(2):(3) = 1:2:1

The content of an inorganic oxide in a charge transporting layer 5 is from 1 to 40% by mass with respect to the solid content of the charge transporting layer 5, and more favorably from 2 to 30% by mass. The content of a resin binder in a charge transporting layer 5 is favorably from 20 to 90% by mass with respect to the solid content excluding an inorganic oxide of the charge transporting layer 5, and more favorably from 30 to 80% by mass. The content of a charge transporting material in a charge transporting layer 5 is favorably from 10 to 80% by mass with respect to the solid content excluding an inorganic oxide of the charge transporting layer 5, and more favorably from 20 to 70% by mass.

The film thickness of a charge transporting layer 5 is preferably in a range of 3 to 50 μm from the viewpoint of maintenance of a surface voltage effective for practical use, and more preferably in a range of 15 to 40 μm.

(Positively-Charged Monolayer Photoreceptor)

In the case of positively-charged monolayer photoreceptor a monolayer photosensitive layer 3 constitutes a photosensitive layer containing the inorganic oxide. In a positively-charged monolayer photoreceptor, a monolayer photosensitive layer 3 is mainly composed of the inorganic oxide, a charge generating material, a positive hole transporting material and an electron transporting material (acceptor compound) as charge transporting materials, and a resin binder.

As a resin binder in a monolayer photosensitive layer 3, various polycarbonate resins, such as a bisphenol A type, a bisphenol Z type, a bisphenol A type-biphenyl copolymer, and a bisphenol Z type-biphenyl copolymer, a polyphenylene resin, a polyester resin, a poly(vinyl acetal) resin, a poly(vinyl butyral) resin, a poly(vinyl alcohol) resin, a vinyl chloride resin, a vinyl acetate resin, a polyethylene resin, a polypropylene resin, an acrylic resin, a polyurethane resin, an epoxy resin, a melamine resin, a silicone resin, a polyamide resin, a polystyrene resin, a polyacetal resin, a polyarylate resin, a polysulfone resin, a polymer of a methacrylate, and a copolymer thereof may be used. Further, the same kind of resins with a different molecular weight may be used in a mixture.

As a charge generating material in a monolayer photosensitive layer 3, for example, a phthalocyanine pigment, an azo pigment, an anthanthrone pigment, a perylene pigment, a perinone pigment, a polycyclic quinone pigment, a squarylium pigment, a thiapyrylium pigment, and a quinacridone pigment may be used. The charge generating materials may be used singly, or in a combination of two or more kinds thereof. Especially, as an azo pigment a disazo pigment, and a trisazo pigment; as a perylene pigment N,N'-bis(3,5-dimethylphenyl)-3,4:9,10-perylene-bis(carboxyimide); as a phthalocyanine pigment metal-free phthalocyanine, copper phthalocyanine, and titanyl phthalocyanine may be used preferably in a photoreceptor according to the present invention. Further, it is preferable to use X-type metal-free phthalocyanine, τ-type metal-free phthalocyanine, ε-type copper phthalocyanine, α-type titanyl phthalocyanine, β-type titanyl phthalocyanine, Y-type titanyl phthalocyanine, amorphous titanyl phthalocyanine, and titanyl phthalocyanine, which shows a maximum peak in an X-ray diffraction spectrum (CuKα) at a Bragg angle 2θ of 9.6° as described in Japanese Unexamined Patent Application Publication No. H8-209023, U.S. Pat. Nos. 5,736,282, and 5,874,570, because a remarkable improvement effect is exhibited in terms of the sensitivity, durability and picture quality.

As a positive hole transporting material in a monolayer photosensitive layer 3, for example, a hydrazone compound, a pyrazoline compound, a pyrazolone compound, an oxadiazole compound, an oxazole compound, an arylamine compound, a benzidine compound, a stilbene compound, a styryl compound, poly(N-vinyl carbazole), and polysilane may be used. The positive hole transporting materials may be used singly, or in a combination of two or more kinds thereof. As a positive hole transporting material to be used according to the present invention, those being superior in transportation capacity of a positive hole generated during light irradiation as well as suitable for a combination with a charge generating material are preferable.

Examples of an electron transporting material (acceptor compound) in a monolayer photosensitive layer 3 include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, a thiopyran-based compound, a quinone-based compound, a benzoquinone compound, a diphenoquinone-based compound, a naphthoquinone-based compound, an anthraquinone-based compound, a stilbenequinone-based compound, and an azoquinone-based compound. The electron transporting materials may be used singly, or in a combination of two or more kinds thereof.

The content of an inorganic oxide in a monolayer photosensitive layer 3 is from 1 to 40% by mass with respect to the solid content in the monolayer photosensitive layer 3, and more favorably from 2 to 30% by mass. The content of a resin binder in a monolayer photosensitive layer 3 is favorably from 10 to 90% by mass with respect to the solid content excluding an inorganic oxide of the monolayer photosensitive layer 3, and more favorably from 20 to 80% by mass. The content of a charge generating material in a monolayer photosensitive layer 3 is favorably from 0.1 to 20% by mass with respect to the solid content excluding an inorganic oxide of the monolayer photosensitive layer 3, and more favorably from 0.5 to 10% by mass. The content of a positive hole transporting material in a monolayer photosensitive layer 3 is favorably from 3 to 80% by mass with respect to the solid content excluding an inorganic oxide of the monolayer photosensitive layer 3, and more favorably from 5 to 60% by mass. The content of an electron transporting material in a monolayer photosensitive layer 3 is favorably from 1 to 50% by mass with respect to the solid content excluding an inorganic oxide of the monolayer photosensitive layer 3, and more favorably from 5 to 40% by mass.

The film thickness of a monolayer photosensitive layer 3 is preferably in a range of 3 to 100 μm from the viewpoint of maintenance of a surface voltage effective for practical use, and more preferably in a range of 5 to 40 μm.

(Positively-Charged Stacked Photoreceptor)

As described above, a photosensitive layer in a positively-charged stacked photoreceptor has a charge transporting layer 5 and a charge generating layer 4. In the case of a positively-charged stacked photoreceptor, a charge generating layer 4 is the outermost layer, and constitutes a photosensitive layer containing the inorganic oxide. A charge transporting layer 5 in a positively-charged stacked photoreceptor is mainly composed of a charge transporting material and a resin binder. As such a charge transporting material and a resin binder, the similar materials as named for a charge transporting layer 5 in a negatively-charged stacked photoreceptor except an inorganic oxide may be used. The content of each material and the film thickness of a charge transporting layer 5 may be the same as a negatively-charged stacked photoreceptor, except an inorganic oxide.

A charge generating layer 4 to be formed on a charge transporting layer 5 is mainly composed of the inorganic oxide, a charge generating material, a positive hole transporting material and an electron transporting material (acceptor compound) as charge transporting materials and a resin binder. As a charge generating material, a positive hole transporting material, an electron transporting material, and a resin binder, the similar materials as named for a monolayer photosensitive layer 3 in a monolayer photoreceptor may be used. The content of each material and the film thickness of a charge generating layer 4 may be the same as monolayer photosensitive layer 3 in a monolayer photoreceptor.

Into both of stacked and monolayer photosensitive layers according to the present invention, a leveling agent, such as silicone oil, and fluorinated oil, may be added for the purpose of improvement of the levelling property of a formed film, or impartation of lubricity. Further, plural kinds of inorganic oxides may be added for the purpose of adjustment of film hardness, reduction of friction coefficient, impartation of lubricity, etc. A metal oxide, such as silica, titanium oxide, zinc oxide, calcium oxide, alumina, and zirconium oxide; a metal sulfate, such as barium sulfate, and calcium sulfate; a fine particle of a metal nitride, such as silicon nitride, and aluminum nitride; a particle of fluorocarbon resin such as a tetrafluoroethylene resin; or a fluorinated comb graft polymer resin may be added. Further, if necessary, another publicly known additive may be added to the extent that electrophotographic characteristics are not significantly impaired.

Further into a photosensitive layer a deterioration preventing agent, such as an antioxidant, and a light stabilizer may be added for the purpose of improvement of environmental resistance, or stability against harmful light. Examples of a compound used for such a purpose include a chromanol derivative and an esterified compound, such as tocopherol, a polyarylalkane compound, a hydroquinone derivative, an etherified compound, a dietherified compound, a benzophenone derivative, a benzotriazole derivative, a thioether compound, a phenylenediamine derivative, a phosphonic acid ester, a phosphite ester, a phenol compound, a hindered phenol compound, a straight chain amine compound, a cyclic amine compound, and a hindered amine compound.

(Method for Producing Photoreceptor)

Figure 3:
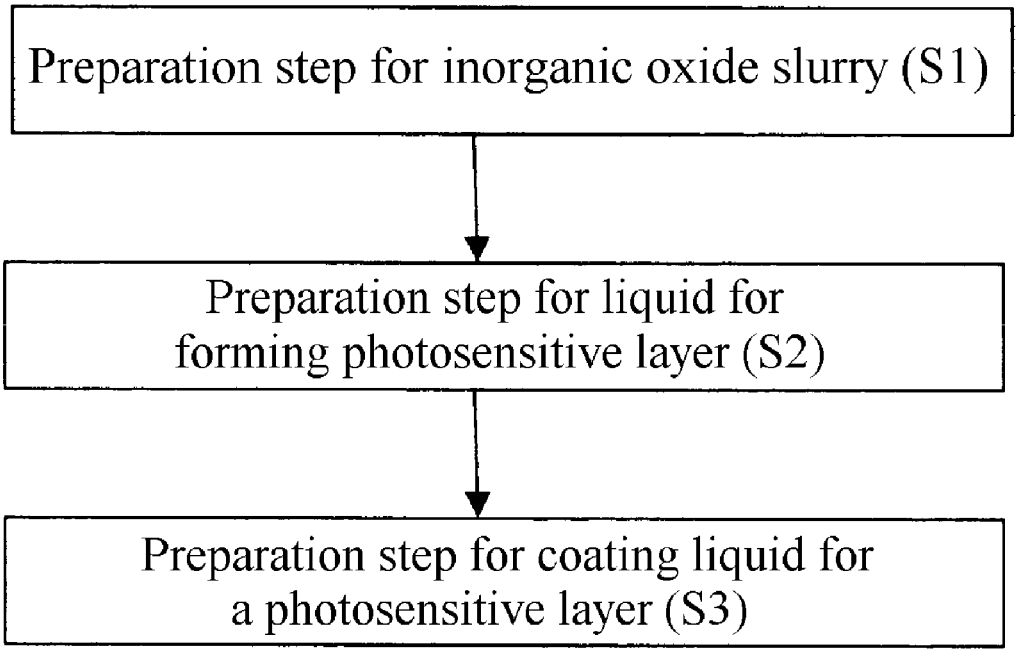
FIG. 3 is a flow diagram showing an example of a method for producing a photoreceptor according to the present invention.

A production method according to the present invention includes the following steps in producing a photoreceptor by forming a photosensitive layer using a coating liquid for a photosensitive layer. Namely, as shown in FIG. 3, an inorganic oxide is dispersed primarily in as solvent for a coating liquid for a photosensitive layer to yield an inorganic oxide slurry (preparation step for inorganic oxide slurry (S1)), a charge transporting material and a resin binder are dissolved in a solvent for a coating liquid for a photosensitive layer to yield a liquid for forming a photosensitive layer (preparation step for liquid for forming photosensitive layer (S2)), and then the yielded inorganic oxide slurry and liquid for forming a photosensitive layer are mixed to yield a coating liquid for a photosensitive layer (preparation step for coating liquid for a photosensitive layer (S3)). In this way a photoreceptor able to form an image, which wears little over a long term use and is stable, can be produced with certainty.

In this regard, there is no particular restriction on preparation of an inorganic oxide slurry, and it may be performed using appropriately the aforedescribed disperser by an ordinary method. There is no particular restriction also on preparation of a liquid for forming a photosensitive layer, or a coating liquid for a photosensitive layer, and it may be performed appropriately by an ordinary method.

(Electrophotographic Device)

An electrophotographic photoreceptor according to the present invention is constituted by mounting the aforedescribed photoreceptor according to the present invention, and exhibits an intended effect when applied to various machine processes. Specifically, it is able to obtain sufficient effect in a charging process, including a contact charging system using a charging member, such as a roller and a brush, and a noncontact charging system using a corotron, a scorotron, etc., and also in a developing process, including a contact developing system, and a noncontact developing system, using a developing system, such as a nonmagnetic 1 component system, a magnetic 1 component system, a 2 component system. The present invention is especially valuable, because abrasion through contact with a charging member may be suppressed, in a case in which a charging process with a contact charging system, where a photoreceptor is charged through contact with a charging member, is equipped.

Figure 2:
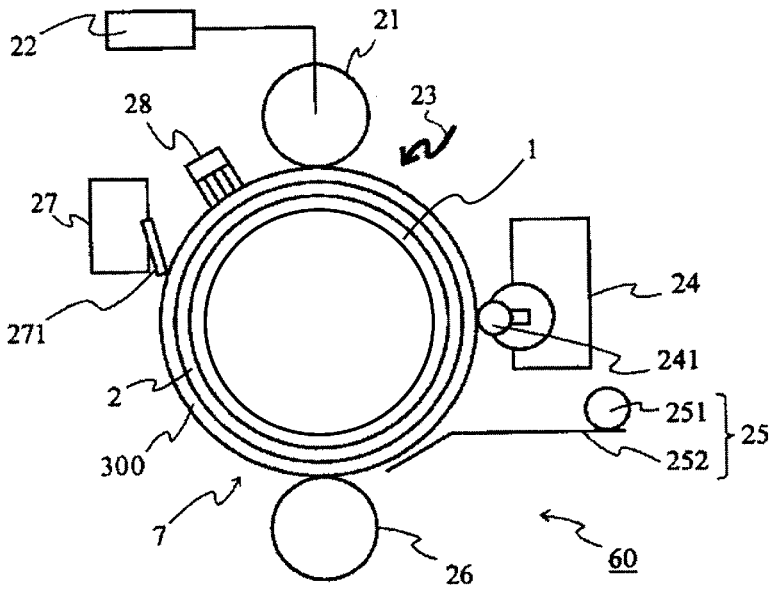
FIG. 2 is a schematic diagram showing an example of an electrophotographic device according to the present invention.

FIG. 2 shows a schematic diagram of an example of an electrophotographic device according to the present invention. The depicted electrophotographic device 60 according to the present invention is equipped with a photoreceptor 7 according to the present invention including a conductive substrate 1, and an undercoat layer 2 and a photosensitive layer 300 coated on the outer peripheral surface of the conductive substrate 1. The electrophotographic device 60 is constituted with a charging member 21 placed on the periphery of the photoreceptor 7; a high-voltage power supply 22 to supply applied voltage to a charging member 21; an image exposing member 23; a developing apparatus 24 provided with a developing roller 241; a paper feed member 25 provided with a paper feed roller 251, and a paper feed guide 252; and a transfer charger (direct charge type) 26. An electrophotographic device 60 may further include a cleaning device 27 provided with a cleaning blade 271; and a discharging member 28. An electrophotographic device 60 may be a color printer.

EXAMPLES

A specific embodiment of the present invention will be described in more detail by way of Examples. The scope of the present invention be not restricted in any way by the following Examples, unless it departs from the gist of the invention.

(Preparation of Inorganic Oxide Slurry)

Production Examples 1 to 44

An inorganic oxide slurry was prepared according to a Production Example in Table 1 or 2. Specifically, a surface-treated silica was prepared by using silica produced by Admatechs Co., Ltd. [YA010C (aluminum element content 500 ppm), YA050C (aluminum element content 900 ppm), YA100C (aluminum element content 900 ppm)], Silica F (aluminum element content 10 ppm), or Silica G (aluminum content 100 ppm) as an inorganic oxide, and surface-treating the same with a treatment agent listed in Table 1 as a surface treatment agent. The surface-treated silica was dispersed in tetrahydrofuran (THF) for a coating liquid for a photosensitive layer (primary dispersion). The amounts of a surface treatment agent for the inorganic oxides after a surface treatment in Production Examples 1, 21, and 33 were analyzed quantitatively to find 1.0, 0.2, and 0.1% by mass respectively with respect to the inorganic oxides after a treatment. The amounts of a surface treatment agent for other Production Examples were similarly analyzed quantitatively to obtain similar results which fall within a range of 0.01 to 10.0% by mass with respect to the mass of an inorganic oxide after a treatment.

Comparative Production Examples 1 to 10

An inorganic oxide slurry was prepared according to a Production Example in Table 1, or 2 identically with Production Example 1, etc. using as an inorganic oxide AEROSIL R7200, and R8200 produced by Nippon Aerosil Co., Ltd. (both are dry process silica with aluminum content of less than 1 ppm), Silica H (aluminum content 2000 ppm), AKP-20 (alumina) produced by Sumitomo Chemical Co., Ltd., MSP-015 and MT-600B produced by Tayca Corporation, or TTO-55 (titanium oxide) produced by Ishihara Sangyo Kaisha, Ltd.

TABLE 1

| | Inorganic oxide | | Surface treatment agent | | Slurry | |
|---|---|---|---|---|---|---|
| | Kind | Primary particle diameter (nm) | Surface treatment agent 1 | Surface treatment agent 2 | Kind of solvent | Inorganic oxide concentration (wt-%) |
| Production Example 1 | Silica A*[1] | 10 | phenyltrimethoxysilane | — | THF | 20 |
| Production Example 2 | Silica A*[1] | 10 | vinyltrimethoxysilane | — | THF | 20 |
| Production Example 3 | Silica A*[1] | 10 | methacryltrimethoxysilane | — | THF | 20 |
| Production Example 4 | Silica A*[1] | 10 | KBM573*[8] | — | THF | 20 |
| Production Example 5 | Silica A*[1] | 10 | phenyltrimethoxysilane | — | THF | 5 |
| Production Example 6 | Silica A*[1] | 10 | phenyltrimethoxysilane | — | THF | 40 |
| Production Example 7 | Silica A*[1] | 10 | phenyltrimethoxysilane | KBM573*[8] | THF | 20 |
| Production Example 8 | Silica A*[1] | 10 | phenyltrimethoxysilane | KBM573*[8] | THF | 5 |
| Production Example 9 | Silica A*[1] | 10 | phenyltrimethoxysilane | KBM573*[8] | THF | 40 |
| Production Example 10 | Silica A*[1] | 10 | phenyltrimethoxysilane | KBM5103*[9] | THF | 20 |
| Production Example 11 | Silica A*[1] | 10 | phenyltrimethoxysilane | KBM603*[10] | THF | 20 |
| Production Example 12 | Silica A*[1] | 10 | phenyltrimethoxysilane | 3-[2-(2-aminoethylamino)ethylamino] propyltrimethoxysilane | THF | 20 |
| Production Example 13 | Silica A*[1] | 10 | phenyltrimethoxysilane | vinylbenzylaminoethyl aminopropyl trimethoxysilane | THF | 20 |
| Production Example 14 | Silica A*[1] | 10 | phenyltrimethoxysilane | trimethoxy[3-(methylamino)propyl]silane | THF | 20 |
| Production Example 15 | Silica A*[1] | 10 | phenyltrimethoxysilane | KBM903*[12] | THF | 20 |
| Production Example 16 | Silica A*[1] | 10 | vinyltrimethoxysilane | KBM903*[12] | THF | 20 |
| Production Example 17 | Silica A*[1] | 10 | methacryltrimethoxysilane | KBM903*[12] | THF | 20 |
| Production Example 18 | Silica A*[1] | 10 | KBM573*[8] | KBM903*[12] | THF | 20 |
| Production Example 19 | Silica A*[1] | 10 | vinyltrimethoxysilane | KBM573*[8] | THF | 20 |
| Production Example 20 | Silica A*[1] | 10 | methacryltrimethoxysilane | KBM573*[8] | THF | 20 |
| Production Example 21 | Silica D*[11] | 50 | phenyltrimethoxysilane | — | THF | 20 |
| Production Example 22 | Silica D*[11] | 50 | KBM573*[8] | — | THF | 20 |
| Production Example 23 | Silica D*[11] | 50 | methacryltrimethoxysilane | — | THF | 20 |
| Production Example 24 | Silica D*[11] | 50 | KBM573*[8] | — | THF | 20 |
| Production Example 25 | Silica D*[11] | 50 | phenyltrimethoxysilane | KBM573*[8] | THF | 20 |
| Production Example 26 | Silica D*[11] | 50 | vinyltrimethoxysilane | KBM573*[8] | THF | 20 |
| Production Example 27 | Silica D*[11] | 50 | methacryltrimethoxysilane | KBM573*[8] | THF | 20 |
| Production Example 28 | Silica D*[11] | 50 | phenyltrimethoxysilane | KBM903*[12] | THF | 20 |
| Production Example 29 | Silica D*[11] | 50 | vinyltrimethoxysilane | KBM903*[12] | THF | 20 |
| Production Example 30 | Silica D*[11] | 50 | methacryltrimethoxysilane | KBM903*[12] | THF | 20 |
| Production Example 31 | Silica D*[11] | 50 | KBM573*[8] | KBM903*[12] | THF | 20 |

TABLE 2

| | Inorganic oxide | | Surface treatment agent | | Slurry | |
|---|---|---|---|---|---|---|
| | Kind | Primary particle diameter (nm) | Surface treatment agent 1 | Surface treatment agent 2 | Kind of solvent | Inorganic oxide concentration (wt-%) |
| Production Example 32 | Silica E*13 | 100 | phenyltrimethoxysilane | — | THF | 20 |
| Production Example 33 | Silica E*13 | 100 | vinyltrimethoxysilane | — | THF | 20 |
| Production Example 34 | Silica E*13 | 100 | methacryltrimethoxysilane | — | THF | 20 |
| Production Example 35 | Silica E*13 | 100 | KBM573*8 | — | THF | 20 |
| Production Example 36 | Silica E*13 | 100 | phenyltrimethoxysilane | KBM573*8 | THF | 20 |
| Production Example 37 | Silica E*13 | 100 | vinyltrimethoxysilane | KBM573*8 | THF | 20 |
| Production Example 38 | Silica E*13 | 100 | methacryltrimethoxysilane | KBM573*8 | THF | 20 |
| Production Example 39 | Silica E*13 | 100 | phenyltrimethoxysilane | KBM903*12 | THF | 20 |
| Production Example 40 | Silica E*13 | 100 | vinyltrimethoxysilane | KBM903*12 | THF | 20 |
| Production Example 41 | Silica E*13 | 100 | methacryltrimethoxysilane | KBM903*12 | THF | 20 |
| Production Example 42 | Silica E*13 | 100 | KBM573*8 | KBM903*12 | THF | 20 |
| Production Example 43 | Silica F*14 | 100 | phenyltrimethoxysilane | — | THF | 20 |
| Production Example 44 | Silica G*15 | 100 | phenyltrimethoxysilane | — | THF | 20 |
| Comparative Production Example 1 | Silica B*2 | 15 | methacryloxypropylsilane | — | THF | 20 |
| Comparative Production Example 2 | Silica B*2 | 15 | methacryloxypropylsilane | — | THF | 5 |
| Comparative Production Example 3 | Silica C*3 | 15 | hexamethyldisilazane | — | THF | 20 |
| Comparative Production Example 4 | Silica C*3 | 15 | hexamethyldisilazane | — | THF | 5 |
| Comparative Production Example 5 | Alumina*4 | 460 | — | — | THF | 20 |
| Comparative Production Example 6 | Alumina*4 | 460 | — | — | THF | 5 |
| Comparative Production Example 7 | Titanium oxide A*5 | 15 | alkylsilane | — | THF | 20 |
| Comparative Production Example 8 | Titanium oxide B*6 | 50 | — | — | THF | 20 |
| Comparative Production Example 9 | Titanium oxide C*7 | 40 | $Al(OH)_3$ | — | THF | 20 |
| Comparative Production Example 10 | Silica H*16 | 100 | phenyltrimethoxysilane | — | THF | 20 |

*1: Silica A: produced by Admatechs Co., Ltd., YA010C, primary particle diameter 10 nm

*2: Silica B: produced by Nippon Aerosil Co., Ltd., AEROSIL R7200, primary particle diameter 15 nm

*3: Silica C: produced by Nippon Aerosil Co., Ltd., AEROSIL R8200, primary particle diameter 15 nm

*4: Alumina: produced by Sumitomo Chemical Co., Ltd., AKP-20, primary particle diameter 460 nm

*5: Titanium oxide A: produced by Tayca Corporation, MSP-015, primary particle diameter 15 nm

*6: Titanium oxide B: produced by Tayca Corporation, MT-600B, primary particle diameter 50 nm

*7: Titanium oxide C: produced by Ishihara Sangyo Kaisha, Ltd., TTO-55, primary particle diameter 40 nm

*8: KBM573: produced by Shin-Etsu Chemical Co., Ltd., N-phenyl-3-aminopropyltrimethoxysilane

*9: KBM5103: produced by Shin-Etsu Chemical Co., Ltd.

*10: KBM603: produced by Shin-Etsu Chemical Co., Ltd.

*11: Silica D: produced by Admatechs Co., Ltd., YA050C, primary particle diameter 50 nm

*12: KBM903: produced by Shin-Etsu Chemical Co., Ltd.

*13: Silica E: produced by Admatechs Co., Ltd., YA100C, primary particle diameter 100 nm

*14: Silica F: Silica adjusted to an aluminum content of 10 ppm according to the method described in a test example in Japanese Unexamined Patent Application Publication No. 2015-117138, primary particle diameter 100 nm

*15: Silica G: Silica adjusted to an aluminum content of 100 ppm according to the method described in a test example in Japanese Unexamined Patent Application Publication No. 2015-117138, primary particle diameter 100 nm

*16: Silica H: Silica adjusted to an aluminum content of 2000 ppm according to the method described in a test example in Japanese Unexamined Patent Application Publication No. 2015-117138, primary particle diameter 100 nm (Production of Negatively-Charged Stacked Photoreceptor)

Example 1

A coating liquid 1 was prepared by dissolving or dispersing 5 parts by mass of an alcohol-soluble nylon (Trade name "CM8000" produced by Toray Industries, Inc.), and 5 parts by mass of titanium oxide fine particles treated with an aminosilane in 90 parts by mass of methanol. The coating liquid 1 was dip-coated as an undercoat layer on the outer circumference of an aluminum-made cylinder with an outer diameter of 30 mm to be used as a conductive substrate 1, and dried at a temperature of 100° C. for 30 min to complete an undercoat layer 2 with a film thickness of 3 μm.

A coating liquid 2 was prepared by dissolving or dispersing 1 part by mass of Y-type titanyl phthalocyanine as a charge generating material, and 1.5 parts by mass of a poly(vinyl butyral) resin (Trade name "S-LEC BM-2", produced by Sekisui Chemical Co., Ltd.) as a resin binder in 60 parts by mass of dichloromethane. The coating liquid 2 was dip-coated on the undercoat layer 2, and dried at a temperature of 80° C. for 30 min to complete a charge generating layer 4 with a film thickness of 3 μm.

Nine (9) parts by mass of a compound expressed by the following structural formula:

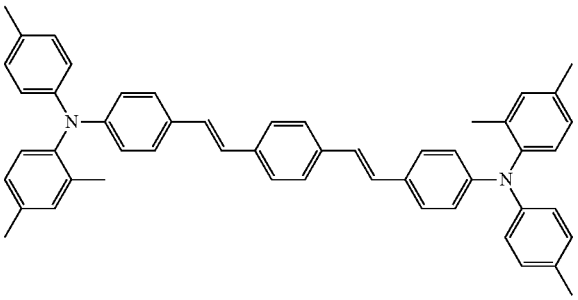

as a charge transporting material (CTM), and 11 parts by mass of a resin having a recurring unit expressed by the following structural formula:

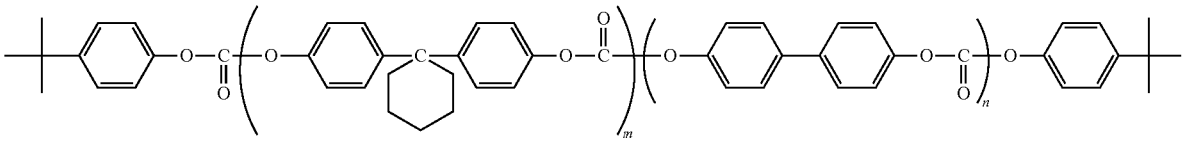

m:n = 60:40 as a resin binder were dissolved in 80 parts by mass of tetrahydrofuran. The liquid was added into 25 parts by mass of the silica slurry prepared in Production Example 1 to prepare a coating liquid 3.

The coating liquid 3 was dip-coated on the charge generating layer 4, dried at a temperature of 120° C. for 60 min to form a charge transporting layer 5 with a film thickness of 20 μm, thereby completing a negatively-charged stacked photoreceptor.

Examples 2 to 25

A photoreceptor was produced by the same method as in Example 1 except that the kind and the amount of the slurry, or the composition of the coating liquid in Production Example 1 used in Example 1 was changed according to the description in Table 3.

Example 26

A photoreceptor was produced by the same method as in Example 1 except that the charge transporting material used in Example 1 was changed to that expressed by the following formula.

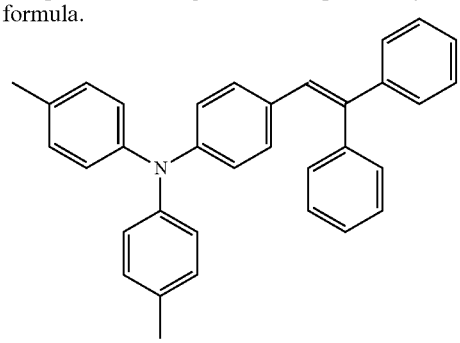

Example 27

A photoreceptor was produced by the same method as in Example 1 except that the charge transporting material used in Example 1 was changed to that expressed by the following formula.

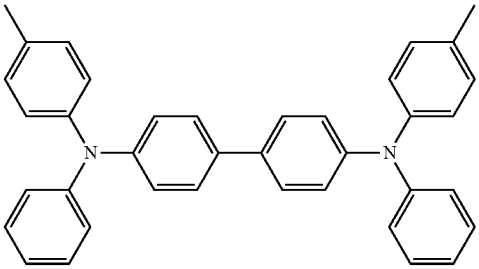

Example 28

A photoreceptor was produced by the same method as in Example 1 except that the charge transporting material used in Example 1 was changed to that expressed by the following formula.

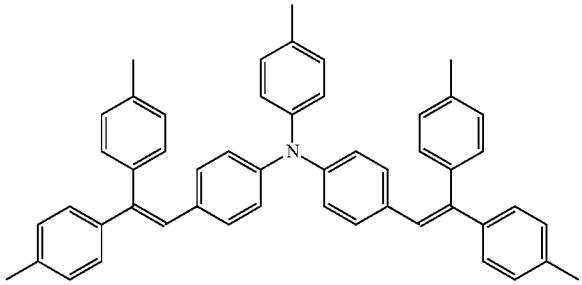

Example 29

A photoreceptor was produced by the same method as in Example 1 except that the charge transporting material used in Example 1 was changed to that expressed by the following formula.

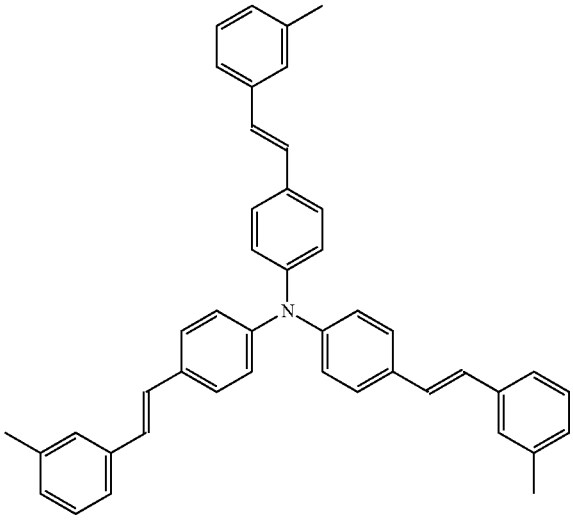

Example 30

A photoreceptor was produced by the same method as in Example 1 except that the charge transporting material used in Example 1 was changed to that expressed by the following formula.

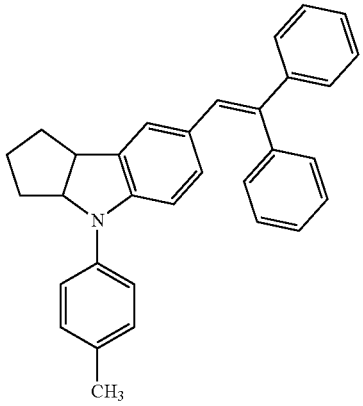

Example 31

A photoreceptor was produced by the same method as in Example 1 except that the charge transporting material used in Example 1 was changed to that expressed by the following formula.

(1)

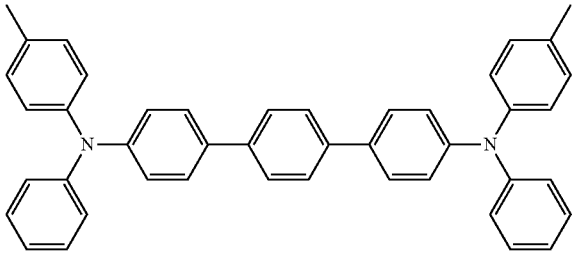

(2)

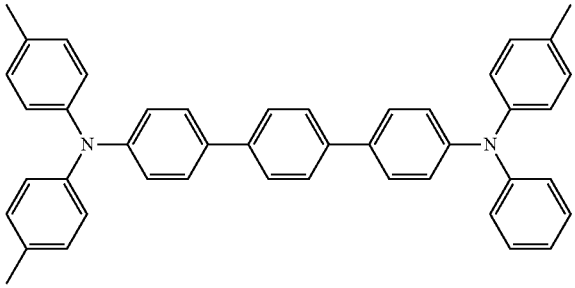

(3)

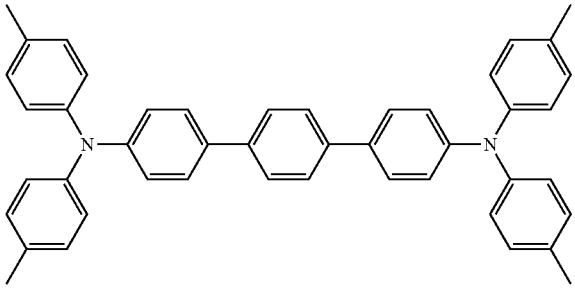

Mixture of (1) (2) (3) = 1:2:3

Example 32

A photoreceptor was produced by the same method as in Example 1 except that the resin binder in the charge transporting layer used in Example 1 was changed to that having the recurring structure expressed by the following formula.

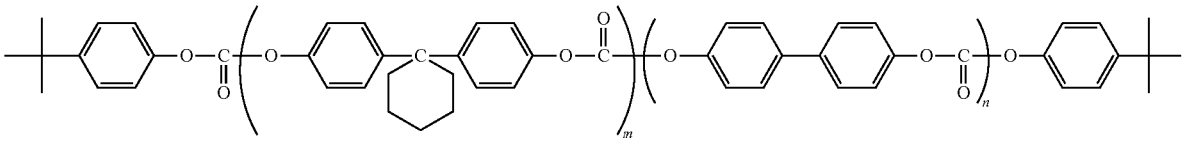

m:n = 85:15

Example 33

A photoreceptor was produced by the same method as in Example 1 except that the resin binder in the charge transporting layer used in Example 1 was changed to that having the recurring structure expressed by the following formula.

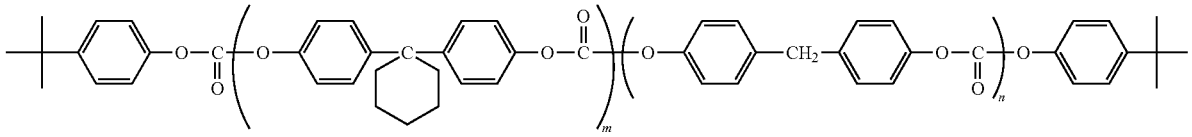

m:n = 50:50

Example 34

A photoreceptor was produced by the same method as in Example 1 except that the resin binder in the charge transporting layer used in Example 1 was changed to that having the recurring structure expressed by the following formula.

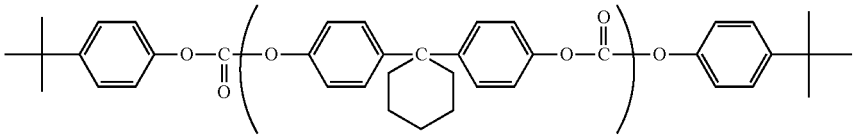

Example 35

A photoreceptor was produced by the same method as in Example 1 except that the resin binder in the charge transporting layer used in Example 1 was changed to that having the recurring structure expressed by the following formula.

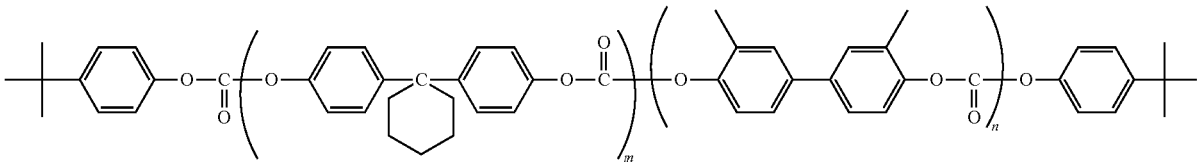

m:n = 60:40

Examples 36 to 56

A photoreceptor was produced by the same method as in Example 1 except that the kind and the amount of the slurry, or the composition of the coating liquid in Production Example 1 used in Example 1 were changed according to the description in Table 4.

Example 57

A photoreceptor was produced by the same method as in Example 36 except that the charge transporting material used in Example 36 was changed to that used in Example 27.

Example 58

A photoreceptor was produced by the same method as in Example 36 except that the resin binder used in Example 36 was changed to that used in Example 35.

Example 59

A photoreceptor was produced by the same method as in Example 48 except that the charge transporting material used in Example 48 was changed to that used in Example 27.

Example 60

A photoreceptor was produced by the same method as in Example 48 except that the resin binder used in Example 48 was changed to that used in Example 35.

Examples 61 to 73

A photoreceptor was produced by the same method as in Example 1 except that the kind and the amount of the slurry in Production Example 1 used in Example 1 were changed according to the description in Table 4.

Comparative Examples 1 to 10

A photoreceptor was produced by the same method as in Example 1 except that the kind and the amount of the slurry in Production Example 1 used in Example 1 were changed according to the description in Table 5.

Comparative Example 11

A photoreceptor was produced by the same method as in Example 1 except that the slurry in Production Example 1 used in Example 1 was not added.

(Production of Positively-Charged Monolayer Photoreceptor)

Example 74

A coating liquid prepared by dissolving with stirring 0.2 part by mass of a vinyl chloride-vinyl acetate-vinyl alcohol copolymer (Trade name "SOLBIN TA5R", produced by Nissin Chemical Co., Ltd.) in 99 parts by mass of ethyl methyl ketone was dip-coated as an undercoat layer on the outer circumference of an aluminum-made cylinder with an outer diameter of 24 mm to be used as a conductive substrate 1, and dried at a temperature of 100° C. for 30 min to complete an undercoat layer 2 with a film thickness of 0.1 μm.

In 80 parts by mass of tetrahydrofuran, 0.1 parts by mass of an X-type metal-free phthalocyanine as a charge generating material, 8 parts by mass of the charge transporting material (CTM) used in Example 1 as a positive hole transporting material, 4 parts by mass of the compound expressed by the following formula:

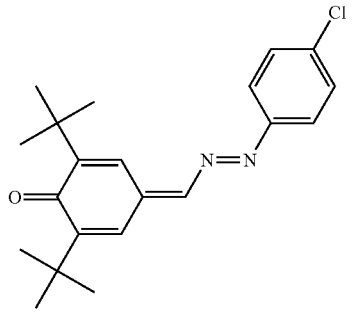

as an electron transporting material (ETM), and 8 parts by mass of the resin binder used in the charge transporting layer in Example 1 as a resin binder were dissolved or dispersed. The liquid was added to 25 parts by mass of the silica slurry prepared in Production Example 1 to produce a coating liquid.

The coating liquid was dip-coated on an undercoat layer 2, and dried at a temperature of 100° C. for 60 min to form a photosensitive layer with a film thickness of 25 μm, thereby completing a monolayer photoreceptor.

Example 75

A photoreceptor was produced by the same method as in Example 74 except that the slurry used in Example 74 was changed to the slurry in Production Example 21.

Comparative Example 12

A photoreceptor was produced by the same method as in Example 74 except that the slurry used in Example 74 was changed to the slurry in Comparative Production Example 1.

Comparative Example 13

A photoreceptor was produced by the same method as in Example 74 except that the slurry used in Example 74 was not added.

(Production of Positively-Charged Stacked Photoreceptor)

Example 76

In 80 parts by mass of tetrahydrofuran, 5 parts by mass of the resin binder used in Example 34, and 5 parts by mass of the charge transporting material used in Example 1 were dissolved to prepare a coating liquid. The coating liquid was dip-coated on the outer circumference of an aluminum-made cylinder with an outer diameter of 24 mm to be used as a conductive substrate 1, and dried at a temperature of 120° C. for 60 min to form a charge transporting layer with a film thickness of 15 μm.

In 120 parts by mass of 1,2-dichloroethane, 0.1 parts by mass of a Y-type titanyl phthalocyanine as a charge generating material, 2 parts by mass of the charge transporting material (CTM) used in Example 1 as a positive hole transporting material, 5 parts by mass of the compound used in Example 72 as an electron transporting material (ETM), and 13 parts by mass of the resin binder used in Example 1 were dissolved or dispersed. The liquid was added to 25 parts by mass of the silica slurry prepared in Production Example 1 to prepare a coating liquid. The coating liquid was dip-coated on a charge transporting layer, and dried at a temperature of 100° C. for 60 min to form a charge generating layer with a film thickness of 15 μm, thereby completing a positively-charged stacked photoreceptor.

Example 77

A photoreceptor was produced by the same method as in Example 76 except that the slurry used in Example 76 was changed to the slurry in Production Example 21.

Comparative Example 14

A photoreceptor was produced by the same method as in Example 76 except that the slurry used in Example 76 was changed to the slurry in Comparison Production Example 1.

Comparative Example 15

A photoreceptor was produced by the same method as in Example 76 except that the slurry used in Example 76 was not added.

<Slurry Transmittance>

With respect to a slurry of each Production Example, an evaluation slurry having primarily dispersed 20% by mass of an inorganic oxide in a solvent for a coating liquid for a photosensitive layer was prepared. Such a sample is referred to as a 20% by mass inorganic oxide slurry. The evaluation slurry was placed in a quartz cell with an optical path length of 10 mm and irradiated with light with a wavelength of 780 nm. Then the light transmittance was measured by a spectrophotometer (UV-3100, produced by Shimadzu Corporation). The light transmittance is also referred to as slurry transmittance. The measured results are also shown in Tables 3 to 5.

<Slurry Viscosity>

With respect to a slurry of each Production Example, a 20% by mass inorganic oxide slurry for evaluation having dispersed 20% by mass of an inorganic oxide in a solvent for a coating liquid for a photosensitive layer was prepared. A viscosity of such a 20% by mass inorganic oxide slurry at 20° C. was measured by a vibration type viscometer (VISCOMATE VM-10A, produced by Sekonic Corporation). Such a viscosity is also referred to as slurry viscosity. The measured results are also shown in Tables 3 to 5.

<Evaluation of Photoreceptor>

The electrical properties of the photoreceptors produced in Examples 1 to 77, and Comparative Examples 1 to 15 were evaluated by the following method. The evaluation results are also shown in Tables 3 to 5.

<Electrical Properties>

The electrical properties of the photoreceptors obtained in the respective Examples and Comparative Examples were evaluated using an OPC Drum Measurement System (CYNTHIA91) produced by Gentec Co., Ltd. by the following method.

With respect to any of photoreceptors of Examples 1 to 73 and Comparative Examples 1 to 11, a photoreceptor surface was electrified to −650 V by corona discharge in a dark place and in an environment of a temperature of 22° C. and a humidity of 50%, and then a surface potential immediately after the electrification $V_0$ was measured. Then, after being left to stand for 5 sec in a dark place, the surface potential $V_5$ was measured, and a potential retention rate at 5 sec after electrification Vk5 (%) was calculated by the following equation (1).

$$Vk5=V_5/V_0\times100 \quad (1)$$

Next, light from a halogen lamp as a light source was split with a filter to 780 nm as 1.0 μW/cm$^2$-exposure light, and the photoreceptor was irradiated therewith for 5 sec from the time point at which the surface potential reached −600V, and an exposure amount required for the surface potential to decay by light attenuation to −300V was rated as E1/2 (μJ/cm$^2$), and a residual potential of a photoreceptor surface at 5 sec after the exposure was rated as Vr5 (V).

With respect to photoreceptors of Examples 74 to 77 and Comparative Examples 12 to 15 the charge potential was set at +650V and the photoreceptor was irradiated with the exposure light from the time point at which the surface potential reached +600V E1/2 was rated similarly as above as an exposure amount required for attenuation of the surface potential down to +300V.

<Characteristics in Actual Use>

Each photoreceptor produced in Examples 1 to 73 and Comparative Examples 1 to 11 was mounted on a printer LJ4250 produced by HP Inc., and 10000 sheets of A4-size paper were printed. On this occasion film thicknesses of a photoreceptor before and after the printing were measured and an average abrasion loss (μm) through the printing was rated. Further for evaluation of image defect, fogging on a white paper and the density of a blackened paper at the initial stage and after the printing on 10000 sheets were visually examined. In a case in which fogging and density decrease did not appear, it was rated as good.

Further, each photoreceptor produced in Examples 74 to 77, and Comparative Examples 12 to 15 was mounted on a printer HL-2040 produced by Brother Industries, Ltd., and 10000 sheets of A4-size paper were printed. Film thicknesses of a photoreceptor before and after the printing were measured and an average abrasion loss (μm) through the printing was rated. Further, similarly to the above, fogging on a white paper and the density of a blackened paper at the initial stage and after the printing on 10000 sheets were visually examined.

TABLE 3

| | Slurry condition | | | | Coating liquid composition (parts) | | |
|---|---|---|---|---|---|---|---|
| | Slurry used | Transmittance (%) | Viscosity (mPa · S) | Slurry addition amount (mass-%) | CTM amount | ETM amount | Resin amount |
| Example 1 | Production Example 1 | 97 | 1.2 | 25.00 | 9 | — | 11 |
| Example 2 | Production Example 1 | 97 | 1.2 | 5.26 | 9 | — | 11 |
| Example 3 | Production Example 1 | 97 | 1.2 | 11.11 | 9 | — | 11 |
| Example 4 | Production Example 1 | 97 | 1.2 | 33.33 | 9 | — | 11 |
| Example 5 | Production Example 2 | 99 | 1.5 | 25.00 | 9 | — | 11 |
| Example 6 | Production Example 3 | 95 | 1.6 | 25.00 | 9 | — | 11 |
| Example 7 | Production Example 4 | 97 | 1.5 | 25.00 | 9 | — | 11 |
| Example 8 | Production Example 5 | 93 | 1 | 100.00 | 9 | — | 11 |
| Example 9 | Production Example 6 | 85 | 2.5 | 12.50 | 9 | — | 11 |

TABLE 3-continued

| | | | | | | | |
|---|---|---|---|---|---|---|---|
| Example 10 | Production Example 7 | 97 | 1.5 | 25.00 | 9 | — | 11 |
| Example 11 | Production Example 8 | 98 | 1.5 | 100.00 | 9 | — | 11 |
| Example 12 | Production Example 9 | 98 | 1.5 | 12.50 | 9 | — | 11 |
| Example 13 | Production Example 10 | 98 | 4.2 | 25.00 | 9 | — | 11 |
| Example 14 | Production Example 11 | 94 | 5.2 | 25.00 | 9 | — | 11 |
| Example 15 | Production Example 12 | 94 | 5.3 | 25.00 | 9 | — | 11 |
| Example 16 | Production Example 13 | 94 | 12 | 25.00 | 9 | — | 11 |
| Example 17 | Production Example 14 | 92 | 5.8 | 25.00 | 9 | — | 11 |
| Example 18 | Production Example 15 | 97 | 1.2 | 25.00 | 9 | — | 11 |
| Example 19 | Production Example 16 | 99 | 1.5 | 25.00 | 9 | — | 11 |
| Example 20 | Production Example 17 | 95 | 1.6 | 25.00 | 9 | — | 11 |
| Example 21 | Production Example 18 | 97 | 1.5 | 25.00 | 9 | — | 11 |
| Example 22 | Production Example 19 | 99 | 1.5 | 25.00 | 9 | — | 11 |
| Example 23 | Production Example 20 | 95 | 1.6 | 25.00 | 9 | — | 11 |
| Example 24 | Production Example 1 | 97 | 1.2 | 25.00 | 8 | — | 12 |
| Example 25 | Production Example 1 | 97 | 1.2 | 25.00 | 7 | — | 13 |
| Example 26 | Production Example 1 | 97 | 1.2 | 25.00 | 9 | — | 11 |
| Example 27 | Production Example 1 | 97 | 1.2 | 25.00 | 9 | — | 11 |
| Example 28 | Production Example 1 | 97 | 1.2 | 25.00 | 9 | — | 11 |
| Example 29 | Production Example 1 | 97 | 1.2 | 25.00 | 9 | — | 11 |
| Example 30 | Production Example 1 | 97 | 1.2 | 25.00 | 9 | — | 11 |
| Example 31 | Production Example 1 | 97 | 1.2 | 25.00 | 9 | — | 11 |
| Example 32 | Production Example 1 | 97 | 1.2 | 25.00 | 9 | — | 11 |
| Example 33 | Production Example 1 | 97 | 1.2 | 25.00 | 9 | — | 11 |
| Example 34 | Production Example 1 | 97 | 1.2 | 25.00 | 9 | — | 11 |
| Example 35 | Production Example 1 | 97 | 1.2 | 25.00 | 9 | — | 11 |

| | Electrical characteristics | | | | Image characteristics | |
|---|---|---|---|---|---|---|
| | Retention rate (%) | Sensitivity ½ (μJ/cm$^2$) | Residual potential (V) | Abrasion loss (μm) | Initial | After durable printing |
| Example 1 | 92.1 | 0.16 | 22 | 1.5 | Good | Good |
| Example 2 | 92.7 | 0.16 | 21 | 1.6 | Good | Good |
| Example 3 | 92.3 | 0.15 | 23 | 1.6 | Good | Good |
| Example 4 | 91.8 | 0.17 | 23 | 1.4 | Good | Good |
| Example 5 | 92.2 | 0.16 | 22 | 1.5 | Good | Good |
| Example 6 | 91.2 | 0.16 | 26 | 1.5 | Good | Good |
| Example 7 | 91.8 | 0.15 | 25 | 1.5 | Good | Good |
| Example 8 | 92.7 | 0.15 | 26 | 1.6 | Good | Good |
| Example 9 | 91.4 | 0.16 | 23 | 1.5 | Good | Good |
| Example 10 | 92.6 | 0.16 | 25 | 1.6 | Good | Good |

TABLE 3-continued

| | | | | | | |
|---|---|---|---|---|---|---|
| Example 11 | 92.4 | 0.17 | 24 | 1.5 | Good | Good |
| Example 12 | 91.9 | 0.16 | 23 | 1.6 | Good | Good |
| Example 13 | 91.8 | 0.16 | 22 | 1.5 | Good | Good |
| Example 14 | 92.5 | 0.15 | 26 | 1.5 | Good | Good |
| Example 15 | 92 | 0.15 | 25 | 1.6 | Good | Good |
| Example 16 | 92.2 | 0.16 | 24 | 1.5 | Good | Good |
| Example 17 | 91.9 | 0.15 | 26 | 1.6 | Good | Good |
| Example 18 | 91.5 | 0.15 | 24 | 1.5 | Good | Good |
| Example 19 | 92.2 | 0.16 | 22 | 1.7 | Good | Good |
| Example 20 | 91.2 | 0.16 | 26 | 1.8 | Good | Good |
| Example 21 | 91.8 | 0.15 | 25 | 1.5 | Good | Good |
| Example 22 | 92.2 | 0.16 | 22 | 1.7 | Good | Good |
| Example 23 | 91.2 | 0.16 | 26 | 1.7 | Good | Good |
| Example 24 | 91.5 | 0.17 | 27 | 1.3 | Good | Good |
| Example 25 | 91.1 | 0.21 | 33 | 1.2 | Good | Good |
| Example 26 | 92.3 | 0.18 | 27 | 1.6 | Good | Good |
| Example 27 | 92.1 | 0.18 | 22 | 1.7 | Good | Good |
| Example 28 | 91.5 | 0.16 | 24 | 1.7 | Good | Good |
| Example 29 | 91.2 | 0.16 | 26 | 1.7 | Good | Good |
| Example 30 | 92.8 | 0.19 | 22 | 1.7 | Good | Good |
| Example 31 | 91 | 0.16 | 24 | 1.7 | Good | Good |
| Example 32 | 91.5 | 0.16 | 23 | 1.6 | Good | Good |
| Example 33 | 92 | 0.16 | 24 | 1.5 | Good | Good |
| Example 34 | 91.8 | 0.16 | 26 | 1.6 | Good | Good |
| Example 35 | 91.8 | 0.16 | 26 | 1.5 | Good | Good |

TABLE 4

| | Slurry condition | | | | Coating liquid composition (parts) | | |
|---|---|---|---|---|---|---|---|
| | Slurry used | Transmittance (%) | Viscosity (mPa · S) | Slurry addition amount (mass-%) | CTM amount | ETM amount | Resin amount |
| Example 36 | Production Example 21 | 55 | 1.1 | 25.00 | 9 | — | 11 |
| Example 37 | Production Example 21 | 55 | 1.1 | 2.04 | 9 | — | 11 |
| Example 38 | Production Example 21 | 55 | 1.1 | 5.26 | 9 | — | 11 |
| Example 39 | Production Example 21 | 55 | 1.1 | 11.11 | 9 | — | 11 |
| Example 40 | Production Example 21 | 55 | 1.1 | 25.00 | 7 | — | 13 |
| Example 41 | Production Example 21 | 55 | 1.1 | 2.04 | 7 | — | 13 |
| Example 42 | Production Example 22 | 53 | 1.2 | 25.00 | 9 | — | 11 |
| Example 43 | Production Example 23 | 52 | 1.4 | 25.00 | 9 | — | 11 |

TABLE 4-continued

| | | | | | | | |
|---|---|---|---|---|---|---|---|
| Example 44 | Production Example 24 | 53 | 1.2 | 25.00 | 9 | — | 11 |
| Example 45 | Production Example 25 | 57 | 1.3 | 25.00 | 9 | — | 11 |
| Example 46 | Production Example 26 | 56 | 1.3 | 25.00 | 9 | — | 11 |
| Example 47 | Production Example 27 | 55 | 1.3 | 25.00 | 9 | — | 11 |
| Example 48 | Production Example 28 | 65 | 1.0 | 25.00 | 9 | — | 11 |
| Example 49 | Production Example 28 | 65 | 1.0 | 2.04 | 9 | — | 11 |
| Example 50 | Production Example 28 | 65 | 1.0 | 5.26 | 9 | — | 11 |
| Example 51 | Production Example 28 | 65 | 1.0 | 11.11 | 9 | — | 11 |
| Example 52 | Production Example 28 | 65 | 1.0 | 25.00 | 7 | — | 13 |
| Example 53 | Production Example 28 | 65 | 1.0 | 2.04 | 7 | — | 13 |
| Example 54 | Production Example 29 | 63 | 1.3 | 25.00 | 9 | — | 11 |
| Example 55 | Production Example 30 | 62 | 1.3 | 25.00 | 9 | — | 11 |
| Example 56 | Production Example 31 | 63 | 1.5 | 25.00 | 9 | — | 11 |
| Example 57 | Production Example 21 | 55 | 1.1 | 25.00 | 9 | — | 11 |
| Example 58 | Production Example 21 | 55 | 1.1 | 25.00 | 9 | — | 11 |
| Example 59 | Production Example 28 | 65 | 1.0 | 25.00 | 9 | — | 11 |
| Example 60 | Production Example 28 | 65 | 1.0 | 25.00 | 9 | — | 11 |
| Example 61 | Production Example 32 | 45 | 1.8 | 25.00 | 9 | — | 11 |
| Example 62 | Production Example 33 | 44 | 1.5 | 25.00 | 9 | | 11 |
| Example 63 | Production Example 34 | 42 | 1.6 | 25.00 | 9 | — | 11 |
| Example 64 | Production Example 35 | 43 | 1.5 | 25.00 | 9 | — | 11 |
| Example 65 | Production Example 36 | 45 | 1.8 | 25.00 | 9 | — | 11 |
| Example 66 | Production Example 37 | 43 | 1.5 | 25.00 | 9 | — | 11 |
| Example 67 | Production Example 38 | 42 | 1.6 | 25.00 | 9 | — | 11 |
| Example 68 | Production Example 39 | 41 | 1.5 | 25.00 | 9 | — | 11 |
| Example 69 | Production Example 40 | 46 | 1.5 | 25.00 | 9 | — | 11 |
| Example 70 | Production Example 41 | 44 | 1.5 | 25.00 | 9 | — | 11 |
| Example 71 | Production Example 42 | 43 | 1.6 | 25.00 | 9 | — | 11 |
| Example 72 | Production Example 43 | 48 | 1.5 | 25.00 | 9 | — | 11 |
| Example 73 | Production Example 44 | 47 | 1.6 | 25.00 | 9 | — | 11 |

| | Electrical characteristics | | | | Image characteristics | |
|---|---|---|---|---|---|---|
| | Retention rate (%) | Sensitivity ½ (μJ/cm$^2$) | Residual potential (V) | Abrasion loss (μm) | Initial | After durable printing |
| Example 36 | 91.1 | 0.17 | 30 | 1.6 | Good | Good |
| Example 37 | 92.8 | 0.16 | 22 | 2.0 | Good | Good |
| Example 38 | 92.5 | 0.17 | 24 | 1.8 | Good | Good |
| Example 39 | 91.5 | 0.17 | 27 | 1.7 | Good | Good |
| Example 40 | 92.0 | 0.16 | 24 | 1.5 | Good | Good |

TABLE 4-continued

| | | | | | | |
|---|---|---|---|---|---|---|
| Example 41 | 92.5 | 0.18 | 30 | 1.9 | Good | Good |
| Example 42 | 91.2 | 0.16 | 26 | 1.9 | Good | Good |
| Example 43 | 91.0 | 0.16 | 26 | 1.9 | Good | Good |
| Example 44 | 91.3 | 0.17 | 29 | 1.7 | Good | Good |
| Example 45 | 92 | 0.17 | 25 | 1.6 | Good | Good |
| Example 46 | 90.5 | 0.18 | 31 | 1.7 | Good | Good |
| Example 47 | 90.9 | 0.18 | 32 | 1.9 | Good | Good |
| Example 48 | 92.2 | 0.17 | 28 | 1.6 | Good | Good |
| Example 49 | 92.9 | 0.16 | 21 | 1.9 | Good | Good |
| Example 50 | 92.8 | 0.16 | 22 | 1.8 | Good | Good |
| Example 51 | 92.5 | 0.16 | 25 | 1.7 | Good | Good |
| Example 52 | 92.4 | 0.18 | 33 | 1.4 | Good | Good |
| Example 53 | 92.5 | 0.18 | 30 | 1.3 | Good | Good |
| Example 54 | 91 | 0.17 | 28 | 2.0 | Good | Good |
| Example 55 | 90.7 | 0.18 | 35 | 2.1 | Good | Good |
| Example 56 | 91.4 | 0.17 | 28 | 1.9 | Good | Good |
| Example 57 | 92.1 | 0.19 | 24 | 1.7 | Good | Good |
| Example 58 | 92.3 | 0.16 | 26 | 1.5 | Good | Good |
| Example 59 | 92.4 | 0.18 | 30 | 1.6 | Good | Good |
| Example 60 | 92.5 | 0.17 | 28 | 1.5 | Good | Good |
| Example 61 | 92.7 | 0.18 | 24 | 2.0 | Good | Good |
| Example 62 | 91.3 | 0.17 | 32 | 2.1 | Good | Good |
| Example 63 | 91.2 | 0.18 | 35 | 2.0 | Good | Good |
| Example 64 | 92 | 0.18 | 30 | 2.0 | Good | Good |
| Example 65 | 92 | 0.17 | 27 | 1.9 | Good | Good |
| Example 66 | 91.3 | 0.18 | 33 | 2.0 | Good | Good |
| Example 67 | 90.8 | 0.17 | 29 | 2.0 | Good | Good |
| Example 68 | 91.3 | 0.18 | 33 | 2.1 | Good | Good |
| Example 69 | 91 | 0.16 | 28 | 1.8 | Good | Good |
| Example 70 | 90.7 | 0.18 | 34 | 2.1 | Good | Good |
| Example 71 | 90.5 | 0.18 | 35 | 2.1 | Good | Good |
| Example 72 | 91.5 | 0.17 | 23 | 2.0 | Good | Good |
| Example 73 | 91.4 | 0.17 | 24 | 1.9 | Good | Good |

TABLE 5

| | Slurry condition | | | | Coating liquid composition (parts) | | |
|---|---|---|---|---|---|---|---|
| | Slurry used | Transmittance (%) | Viscosity (mPa · S) | Slurry addition amount (mass-%) | CTM amount | ETM amount | Resin amount |
| Comp. Example 1 | Com. Production Example 1 | >0.01 | Sedimentation Unmeasurable | 25.00 | 9 | — | 11 |
| Comp. Example 2 | Comp. Production Example 2 | >0.01 | Sedimentation Unmeasurable | 25.00 | 9 | — | 11 |
| Comp. Example 3 | Comp. Production Example 3 | >0.01 | Sedimentation Unmeasurable | 25.00 | 9 | — | 11 |
| Comp. Example 4 | Comp. Production Example 4 | >0.01 | Sedimentation Unmeasurable | 25.00 | 9 | — | 11 |
| Comp. Example 5 | Comp. Production Example 5 | >0.01 | Sedimentation Unmeasurable | 25.00 | 9 | — | 11 |
| Comp. Example 6 | Comp. Production Example 6 | >0.01 | Sedimentation Unmeasurable | 25.00 | 9 | — | 11 |
| Comp. Example 7 | Comp. Production Example 7 | >0.01 | 1000< (gel) | 25.00 | 9 | — | 11 |
| Comp. Example 8 | Comp. Production Example 8 | >0.01 | 1000< (gel) | 25.00 | 9 | — | 11 |
| Comp. Example 9 | Comp. Production Example 9 | >0.01 | 1000< (gel) | 25.00 | 9 | — | 11 |
| Comp. Example 10 | Comp. Production Example 10 | 38 | 15 | 25.00 | 9 | — | 11 |
| Comp. Example 11 | — | — | — | none | 9 | — | 11 |
| Example 74 | Production Example 1 | 97 | 1.2 | 25.00 | 8 | 4 | 8 |
| Example 75 | Production Example 21 | 55 | 1.1 | 25.00 | 8 | 4 | 8 |
| Example 76 | Production Example 1 | 97 | 1.2 | 25.00 | 2 | 5 | 13 |
| Example 77 | Production Example 21 | 55 | 1.1 | 25.00 | 2 | 5 | 13 |
| Comp. Example 12 | Comp. Production Example 1 | >0.01 | Sedimentation Unmeasurable | 25.00 | 8 | 4 | 8 |
| Comp. Example 13 | — | — | — | none | 8 | 4 | 8 |
| Comp. Example 14 | Comp. Production Example 1 | >0.01 | Sedimentation Unmeasurable | 25.00 | 2 | 5 | 13 |
| Comp. Example 15 | — | — | — | none | 2 | 5 | 13 |

| | Electrical characteristics | | | | Image characteristics | |
|---|---|---|---|---|---|---|
| | Retention rate (%) | Sensitivity ½ (μJ/cm$^2$) | Residual potential (V) | Abrasion Loss (μm) | Initial | After durable printing |
| Comp. Example 1 | 75.1 | 0.24 | 56 | 3.1 | Fogging occurred | Fogging occurred Density decreased |
| Comp. Example 2 | 78 | 0.27 | 82 | 3.6 | Fogging occurred | Fogging occurred Density decreased |
| Comp. Example 3 | 72.5 | 0.28 | 88 | 3.2 | Fogging occurred | Fogging occurred Density decreased |

TABLE 5-continued

| | | | | | | |
|---|---|---|---|---|---|---|
| Comp. Example 4 | 76.4 | 0.26 | 72 | 4.5 | Fogging occurred | Fogging occurred Density decreased |
| Comp. Example 5 | 71.2 | 0.31 | 105 | 3.6 | Fogging occurred | Fogging occurred Density decreased |
| Comp. Example 6 | 78.7 | 0.30 | 102 | 4.0 | Fogging occurred | Fogging occurred Density decreased |
| Comp. Example 7 | 70.3 | 0.36 | 113 | 4.2 | Fogging occurred | Fogging occurred Density decreased |
| Comp. Example 8 | 71.1 | 0.34 | 105 | 4.3 | Fogging occurred | Fogging occurred Density decreased |
| Comp. Example 9 | 72.6 | 0.37 | 124 | 4.5 | Fogging occurred | Fogging occurred Density decreased |
| Comp. Example 10 | 82.1 | 0.23 | 45 | 2.6 | Fogging occurred | Fogging occurred Density decreased |
| Comp. Example 11 | 93 | 0.16 | 24 | 2.5 | Good | Good |
| Example 74 | 85.3 | 0.38 | 45 | 2.3 | Good | Good |
| Example 75 | 86.1 | 0.39 | 43 | 2.4 | Good | Good |
| Example 76 | 88.2 | 0.2 | 30 | 1.6 | Good | Good |
| Example 77 | 88.5 | 0.2 | 28 | 1.6 | Good | Good |
| Comp. Example 12 | 72.8 | 0.55 | 85 | 5.0 | Fogging occurred | Fogging occurred Density decreased |
| Comp. Example 13 | 85.8 | 0.37 | 41 | 5.1 | Good | Good |
| Comp. Example 14 | 72.8 | 0.55 | 85 | 4.0 | Fogging occurred | Fogging occurred Density decreased |
| Comp. Example 15 | 88 | 0.38 | 42 | 4.2 | Good | Good |

It is clear from the results in Tables 3 to 5 that Examples 1 to 77 using an inorganic oxide, the slurry of which has a high transmittance and a low viscosity, exhibit superior resistance to abrasion, and superior electrical properties as a photoreceptor, as well as superior image quality at the initial stage and also after the printing on 10000 sheets. On the other hand, it was confirmed with respect to Comparative Examples 1 to 15 that the abrasion loss through the durable printing was severe, or fogging occurred on an image, and print density decrease was recognized. With respect to Examples 1 to 77, although the mechanism is not very clear, since in a slurry state the transmittance is high and the dispersibility is superior, when formed into a photosensitive layer, the film structure seemingly becomes uniform, which contributes to image stability. Further, it is understandable that the resistance to abrasion of a film of each Example is enhanced due to enhancement of the film strength compared to Comparative Example where an inorganic oxide is not added.

As described above, it has been confirmed that by preparing a photosensitive layer containing an inorganic oxide satisfying the requirement with respect to transmittance according to the present invention, an electrophotographic photoreceptor to yield a fine image without an image defect may be obtained, while abrasion being suppressed.

What is claimed is:

1. An electrophotographic photoreceptor, comprising:

a conductive substrate; and as an outermost layer, a photosensitive layer that comprises an inorganic oxide and that is formed on the conductive substrate from a coating liquid, wherein the inorganic oxide comprises silica as a main component and from 1ppm to 1000 ppm of aluminum, wherein the inorganic oxide is surface-treated with a silane coupling agent which is a surface treatment agent containing at least one material selected from the group consisting of vinyltrimethoxysilane, epoxytrimethoxysilane, methacryltrimethoxysilane, aminotrimethoxysilane, ureidotrimethoxysilane, mercaptopropyltrimethoxysilane, isocyanatopropyltrimethoxysilane, phenylaminotrimethoxysilane, acryltrimethoxysilane, p-styryltrimethoxysilane, 3-acryloxypropyltrimethoxysilane, 3-isocyanatopropyltri-methoxysilane, 3-aminopropyltrimethoxysilane, and N-phenyl-3-aminopropyltri-methoxysilane, and wherein a test slurry containing 20% by mass of the inorganic oxide dispersed in a solvent for forming the coating liquid has a light transmittance of 40% or more in a test case where light having a wavelength of 780 nm irradiates the test slurry.

2. The electrophotographic photoreceptor according to claim 1, wherein the test slurry has a viscosity of 50 mPa·s or less.

3. The electrophotographic photoreceptor according to claim 1, wherein the inorganic oxide has a primary particle diameter ranging from 1 to 200 nm.

4. The electrophotographic photoreceptor according to claim 1, wherein the silane coupling agent has a structure expressed by general formula (1) below:

$$(R^1)_n—Si—(OR^2)_{4-n} \quad (1),$$

where Si represents a silicon atom, $R^1$ represents an organic group in which carbon bonds directly to the silicon atom, $R^2$ represents an organic group, and n represents an integer of 0 to 3.

5. The electrophotographic photoreceptor according to claim 1, wherein the inorganic oxide is surface-treated with plural kinds of the silane coupling agent, and a silane coupling agent used initially for the surface treatment has a structure expressed by general formula (1) below:

$$(R^1)_n—Si—(OR^2)_{4-n} \quad (1),$$

where Si represents a silicon atom, $R^1$ represents an organic group in which carbon bonds directly to the silicon atom, $R^2$ represents an organic group, and n represents an integer of 0 to 3.

6. The electrophotographic photoreceptor according to claim 1, wherein the coating liquid for the photosensitive layer contains a compound having a structure expressed by general formula (2) below in an amount of 2% by mass or less:

$$Si(OH)_m(R^1)_n(OR^2)_{4-(n+m)} \quad (2),$$

where Si represents a silicon atom, $R^1$ represents an organic group in which carbon bonds directly to the silicon atom, $R^2$ represents an organic group, m represents an integer of 1 to 4, and n represents an integer of 0 to 3, while m +n is 4 or less.

7. The electrophotographic photoreceptor according to claim 1, wherein the photosensitive layer further comprises a charge transporting material and a resin binder, and wherein the coating liquid comprises the inorganic oxide dispersed in the solvent mixed with the charge transporting material and the resin binder dissolved in the solvent.

8. The electrophotographic photoreceptor according to claim 7, wherein the charge transporting material comprises an arylamine compound.

9. The electrophotographic photoreceptor according to claim 7, wherein the charge transporting material comprises an electron transporting material.

10. The electrophotographic photoreceptor according to claim 1, wherein the photosensitive layer further comprises a charge transporting material, a resin binder, and a charge generating material, and wherein the coating liquid comprises the inorganic oxide dispersed in the solvent mixed with the charge transporting material and the resin binder dissolved in the solvent to provide a mixture, and the charge generating material dispersed in the mixture.

11. The electrophotographic photoreceptor according to claim 10, comprising a phthalocyanine compound as the charge generating material.

12. A method for producing the electrophotographic photoreceptor according to claim 1, comprising:

preparing the coating liquid for the photosensitive layer, including:

a. dispersing the inorganic oxide in the solvent for the coating liquid to provide an inorganic oxide slurry containing silica as a main component and from 1 ppm to 1000 ppm of aluminum;

b. dissolving a charge transporting material and a resin binder in a solvent to provide a coating liquid precursor; and c. mixing the inorganic oxide slurry and the coating liquid precursor to form the coating liquid; and coating the coating liquid onto the conductive substrate to provide a coated layer for the photosensitive layer of the electrophotographic photoreceptor.

13. The method according to claim 12, further comprising drying the coated layer in a drying apparatus under conditions of temperature, pressure, and duration effective for drying to provide the photosensitive layer of the electrophotographic photoreceptor.

14. An electrophotographic device equipped with the electrophotographic photoreceptor according to claim 1.

15. A coating liquid for forming a photosensitive layer, comprising:

an inorganic oxide slurry comprising an inorganic oxide having silica as a main component and from 1 ppm to 1000 ppm of aluminum, dispersed in a solvent; and a coating precursor liquid comprising a charge transporting material and a resin binder dissolved in the solvent, and mixed with the inorganic oxide slurry, wherein a test slurry containing 20% by mass of the inorganic oxide dispersed in a solvent for forming the coating liquid has a light transmittance of 40% or more in a test case where light having a wavelength of 780 nm irradiates the test slurry.

* * * * *